US006648179B2

(12) United States Patent
Lewis et al.

(10) Patent No.: US 6,648,179 B2
(45) Date of Patent: Nov. 18, 2003

(54) SELF-CONTAINED VISCOUS LIQUID DISPENSER

(75) Inventors: Richard P. Lewis, Marietta, GA (US); Cleary E. Mahaffey, Suwanne, GA (US); Pamela J. Mayberry, Roswell, GA (US); Paul F. Tramontina, Alpharetta, GA (US); David J. Powling, East Grindstead (GB); Mark A. Bennett, Norcross, GA (US); Randall M. Bachtel, Duluth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/911,361

(22) Filed: Jul. 23, 2001

(65) Prior Publication Data

US 2002/0079331 A1 Jun. 27, 2002

Related U.S. Application Data

(63) Continuation-in-part of application No. 09/741,570, filed on Dec. 19, 2000.

(51) Int. Cl.[7] ..... B67D 5/38

(52) U.S. Cl. ..... 222/156; 222/183.1; 222/321.7

(58) Field of Search ..... 222/156, 181.3, 222/321.1, 321.7, 325, 340, 383.1

(56) References Cited

U.S. PATENT DOCUMENTS

| | | | |
|---|---|---|---|
| 1,586,398 | A | 5/1926 | Bobrick |
| 2,184,439 | A | 12/1939 | Schwarcz |
| 2,545,988 | A | 3/1951 | Bobrick |

(List continued on next page.)

FOREIGN PATENT DOCUMENTS

| | | | |
|---|---|---|---|
| DE | 2254386 | | 5/1973 |
| EP | 0395380 | | 10/1990 |
| EP | 0498275 | A1 | 8/1992 |
| EP | 0530789 | B1 | 9/1992 |
| EP | 0659380 | A1 | 6/1995 |
| FR | 2151586 | | 4/1973 |
| FR | 2325346 | | 4/1977 |
| FR | 2653100 | | 10/1989 |
| GB | 818363 | | 8/1959 |
| GB | 2155435 | | 9/1985 |
| NL | 9201928 | | 6/1994 |
| WO | 9716107 | | 5/1997 |
| WO | 9809732 | | 3/1998 |
| WO | 0068038 | | 11/2000 |

OTHER PUBLICATIONS

PCT Search Report—PCT/US01/48975, May 21, 2002.
PCT Search Report—PCT/US01/44905, Apr. 17, 2002.
EPO Search Report—PCT/US02/05698, Jul. 8, 2002.
U.S. Ser. No. 09/741,570, Filed Dec. 19, 2000.
U.S. Ser. No. 09/911,073, Filed Jul. 23, 2001.
U.S. Ser. No. 09/964,289, Filed Sep. 26, 2001.
U.S. Ser. No. 09/964,290, Filed Sep. 26, 2001.
U.S. Ser. No. 09/997,278, Filed Nov. 28, 2001.
U.S. application Ser. No. 09/821,835, Filed Mar. 30, 2001.
U.S. application Ser. No. 09/741,497, Filed Dec. 19, 2000.

*Primary Examiner*—Joseph A. Kaufman
(74) *Attorney, Agent, or Firm*—Dority & Manning

(57) ABSTRACT

A viscous liquid dispenser includes a housing that defines an internal liquid reservoir. A dispensing pump mechanism is disposed in communication with the reservoir and has a delivery end extending from the housing for manual operation by a user. A mounting mechanism is configured as an integral component of the housing and provides the dispenser with the ability to be detachably connected to complimentary mounting structure on a wall surface. The configuration of the dispenser allows for a significantly increased capacity (volume) without a corresponding increase in the weight of the dispenser materials as compared to conventional dispensers.

19 Claims, 18 Drawing Sheets

U.S. PATENT DOCUMENTS

| | | | |
|---|---|---|---|
| 2,605,021 | A | 7/1952 | Churchill et al. |
| 2,622,539 | A | 12/1952 | Martin |
| 2,628,569 | A | 2/1953 | Gilmore |
| 3,533,526 | A | 10/1970 | Adell |
| 3,721,370 | A | 3/1973 | Blum |
| 3,952,918 | A | 4/1976 | Poitras et al. |
| 3,955,715 | A | 5/1976 | Topor |
| 4,018,363 | A | 4/1977 | Cassia |
| 4,036,406 | A | 7/1977 | Jespersen et al. |
| D246,338 | S | 11/1977 | Jespersen |
| 4,120,619 | A | 10/1978 | Blackband |
| 4,142,651 | A | 3/1979 | Leopoldi et al. |
| 4,159,788 | A | 7/1979 | Doyel |
| 4,164,306 | A | 8/1979 | Perrin |
| 4,166,553 | A | 9/1979 | Fraterrigo |
| D253,441 | S | 11/1979 | Tucker |
| 4,174,056 | A | 11/1979 | Loeffler |
| 4,236,655 | A | 12/1980 | Humphries |
| 4,248,398 | A | 2/1981 | Doyel |
| 4,314,658 | A | 2/1982 | Laauwe |
| 4,330,071 | A | 5/1982 | Ohlson |
| 4,349,133 | A | 9/1982 | Christine |
| 4,360,130 | A | 11/1982 | Nishimura et al. |
| D268,154 | S | 3/1983 | Frassanito |
| 4,394,938 | A | 7/1983 | Frassanito |
| 4,410,109 | A | 10/1983 | Murrell, Jr. et al. |
| 4,421,254 | A | 12/1983 | Spector |
| 4,470,523 | A | 9/1984 | Spector |
| 4,489,857 | A | 12/1984 | Batlas |
| 4,493,440 | A | 1/1985 | von Buelow et al. |
| 4,502,617 | A | 3/1985 | Stecker et al. |
| 4,519,530 | A | 5/1985 | Schmidt |
| 4,546,904 | A | 10/1985 | Frassanito |
| 4,561,571 | A | 12/1985 | Chen |
| 4,570,833 | A | 2/1986 | Vanderjagt |
| 4,573,612 | A | 3/1986 | Maddison et al. |
| 4,621,749 | A | 11/1986 | Kanfer |
| 4,646,945 | A | 3/1987 | Steiner et al. |
| 4,650,095 | A | 3/1987 | Tella et al. |
| 4,660,747 | A | 4/1987 | Borg et al. |
| 4,662,195 | A | 5/1987 | von Buelow et al. |
| 4,673,109 | A | 6/1987 | Cassia |
| 4,679,709 | A | 7/1987 | Poitras et al. |
| 4,705,195 | A | 11/1987 | Heck |
| D299,399 | S | 1/1989 | Lippman |
| 4,805,814 | A | 2/1989 | Allen, Sr. |
| 4,811,870 | A | 3/1989 | Bianco |
| 4,834,269 | A | 5/1989 | Cone |
| 4,886,192 | A | 12/1989 | Cassia |
| 4,895,276 | A | 1/1990 | Maldonado |
| 4,949,877 | A | 8/1990 | Hanna et al. |
| 4,964,544 | A | 10/1990 | Hanna et al. |
| D312,184 | S | 11/1990 | De Luca et al. |
| 4,972,973 | A | 11/1990 | Davis |
| 4,972,978 | A | 11/1990 | DeLuca |
| 4,974,753 | A | 12/1990 | Tucker et al. |
| 4,978,036 | A | 12/1990 | Burd |
| 4,991,747 | A | 2/1991 | Van Brocklin |
| 4,993,600 | A | 2/1991 | Tucker et al. |
| 5,042,691 | A | 8/1991 | Maldonado |
| 5,044,900 | A | 9/1991 | Cavallaro |
| D321,453 | S | 11/1991 | Ophardt |
| 5,079,013 | A | 1/1992 | Belanger |
| 5,131,568 | A | 7/1992 | Ringuette |
| 5,154,328 | A | 10/1992 | Gueret |
| 5,165,577 | A | 11/1992 | Ophardt |
| 5,174,476 | A | 12/1992 | Steiner et al. |
| D332,544 | S | 1/1993 | Steiner et al. |
| 5,178,300 | A | 1/1993 | Haviv et al. |
| 5,183,182 | A | 2/1993 | Comstock et al. |
| 5,184,760 | A | 2/1993 | Weinstein et al. |
| 5,186,368 | A | 2/1993 | Garcia |
| 5,190,191 | A | 3/1993 | Reyman |
| 5,209,377 | A | 5/1993 | Steiner et al. |
| 5,213,236 | A | 5/1993 | Brown et al. |
| 5,217,147 | A | 6/1993 | Kaufman |
| 5,261,557 | A | 11/1993 | Bytell et al. |
| 5,265,772 | A | 11/1993 | Bartasevich et al. |
| D342,176 | S | 12/1993 | Steiner et al. |
| 5,275,309 | A | 1/1994 | Baron et al. |
| 5,282,552 | A | 2/1994 | Ophardt |
| D345,664 | S | 4/1994 | Brandenburg |
| D345,877 | S | 4/1994 | Brandenburg |
| 5,303,851 | A | 4/1994 | Libit et al. |
| 5,305,916 | A | 4/1994 | Suzuki et al. |
| 5,307,962 | A | 5/1994 | Lin |
| 5,316,135 | A | 5/1994 | Kneer et al. |
| 5,322,198 | A | 6/1994 | Ichikawa |
| D349,827 | S | 8/1994 | Brandenburg |
| 5,339,995 | A | 8/1994 | Brown et al. |
| 5,339,999 | A | 8/1994 | Montesissa |
| D350,665 | S | 9/1994 | Ophardt |
| 5,363,993 | A | 11/1994 | Mascitelli et al. |
| 5,373,970 | A | 12/1994 | Ophardt |
| 5,377,877 | A | 1/1995 | Brown et al. |
| 5,379,919 | A | 1/1995 | Gueret |
| 5,409,144 | A | 4/1995 | Brown |
| 5,413,250 | A | 5/1995 | Gueret |
| 5,413,251 | A | 5/1995 | Adamson |
| D359,408 | S | 6/1995 | Frassanito |
| 5,421,489 | A | 6/1995 | Holzner, Sr. et al. |
| 5,427,279 | A | 6/1995 | Kaufman |
| 5,429,275 | A | 7/1995 | Katz |
| 5,431,309 | A | 7/1995 | Ophardt |
| 5,439,143 | A | 8/1995 | Brown et al. |
| 5,439,144 | A | 8/1995 | Holzner |
| 5,443,236 | A | 8/1995 | Bell et al. |
| 5,452,825 | A | 9/1995 | Comstock et al. |
| 5,464,125 | A | 11/1995 | Daansen |
| 5,489,044 | A | 2/1996 | Ophardt |
| 5,501,372 | A | 3/1996 | Daansen |
| 5,524,793 | A | 6/1996 | O'Neill |
| 5,556,005 | A | 9/1996 | Banks |
| 5,595,324 | A | 1/1997 | Brown et al. |
| 5,597,097 | A | 1/1997 | Morris |
| D378,035 | S | 2/1997 | Ophardt |
| 5,598,952 | A | 2/1997 | Daansen |
| 5,605,256 | A | 2/1997 | Fan |
| 5,632,418 | A | 5/1997 | Brown |
| D379,728 | S | 6/1997 | Simon |
| 5,638,989 | A | 6/1997 | Ophardt et al. |
| 5,649,643 | A | 7/1997 | Ridgeway |
| D383,631 | S | 9/1997 | Wirt et al. |
| 5,667,105 | A | 9/1997 | Hartley et al. |
| 5,676,277 | A | 10/1997 | Ophardt |
| D386,640 | S | 11/1997 | Wirt et al. |
| 5,687,877 | A | 11/1997 | Smolen, Jr. |
| D388,990 | S | 1/1998 | Brandenburg et al. |
| 5,704,522 | A | 1/1998 | Orgeolet et al. |
| D391,431 | S | 3/1998 | Brandenburg et al. |
| 5,725,131 | A | 3/1998 | Bell et al. |
| 5,743,440 | A | 4/1998 | De Laforcade |
| D395,774 | S | 7/1998 | Phillips et al. |
| 5,779,109 | A | 7/1998 | Gueret |
| 5,799,826 | A | 9/1998 | Brown et al. |
| 5,799,841 | A | 9/1998 | Wirt |
| 5,810,203 | A | 9/1998 | Brennan |
| 5,810,204 | A | 9/1998 | Devlin et al. |
| 5,816,453 | A | 10/1998 | Spencer et al. |
| 5,823,397 | A | 10/1998 | Gil |
| 5,826,755 | A | 10/1998 | Burd |

5,829,640 A 11/1998 Hershey et al.
5,839,614 A 11/1998 Brown
5,842,609 A 12/1998 Higgins et al.
5,842,611 A 12/1998 Vivier
5,850,948 A 12/1998 Garcia et al.
5,860,574 A 1/1999 Shanklin et al.
5,862,956 A 1/1999 Brandenburg et al.
5,865,352 A 2/1999 Leary
5,887,762 A 3/1999 Hanna
5,897,031 A 4/1999 Wirt et al.
5,899,363 A 5/1999 Bliss, III et al.
5,908,143 A 6/1999 Crossdale et al.
5,927,561 A 7/1999 Foster et al.
5,927,566 A 7/1999 Mueller
5,927,567 A 7/1999 Fillmore
5,944,227 A 8/1999 Schroeder et al.
5,944,234 A 8/1999 Lampe et al.
D414,363 S 9/1999 Daansen
5,947,338 A 9/1999 Budsworth et al.
5,971,232 A 10/1999 Rohr et al.
5,975,360 A 11/1999 Ophardt
6,016,936 A 1/2000 Fan
6,026,993 A 2/2000 Sperna Weiland
6,036,058 A 3/2000 Chou
6,070,763 A 6/2000 Gueret
6,076,707 A 6/2000 Feldner
6,089,410 A 7/2000 Ponton
6,089,411 A 7/2000 Baudin et al.
6,112,951 A 9/2000 Mueller
6,112,952 A 9/2000 Hess, III et al.
6,119,902 A 9/2000 Shimada et al.
6,131,773 A 10/2000 Wade et al.
6,131,806 A 10/2000 Hess, III et al.
6,152,330 A 11/2000 Polan
6,186,361 B1 2/2001 Teetsel, III
6,189,740 B1 2/2001 Wade et al.
6,193,112 B1 2/2001 Santagiuliana
6,209,752 B1 4/2001 Mitchell et al.
6,230,935 B1 5/2001 Mack et al.
6,234,361 B1 5/2001 Bloom
6,237,807 B1 5/2001 Uhl et al.
6,240,979 B1 6/2001 Lorscheidt
6,257,844 B1 7/2001 Stern
6,273,297 B1 8/2001 Schalow et al.
6,273,305 B1 8/2001 Fioravanti et al.
6,279,777 B1 8/2001 Goodin et al.
6,321,943 B1 11/2001 Strickler et al.
6,338,442 B1 1/2002 De Laforcade
6,343,724 B1 2/2002 Ophardt et al.
6,345,734 B2 2/2002 Schalow et al.
6,345,736 B1 2/2002 Berry et al.

SELF-CONTAINED VISCOUS LIQUID DISPENSER

RELATED APPLICATIONS

The present application is a Continuation-In-Part (CIP) application of U.S. Ser. No. 09/741,570 filed on Dec. 19, 2000.

FIELD OF THE INVENTION

The present invention relates to the field of viscous liquid dispensers, for example soap dispensers, shampoo and lotion dispensers, food product dispensers, and the like.

BACKGROUND OF THE INVENTION

Various configurations and models of liquid dispensers, particularly liquid soap dispensers, are well known in the art. Conventional dispensers typically employed in public restrooms and the like are wall mounted units that typically include a house or structure that is permanently affixed to a wall. These dispensers typically include an access door or member so that the dispenser can be opened by a maintenance person for refilling or servicing. With certain types of dispensers, separate refill cartridges are inserted into the housing structure. With other types of dispensers, the maintenance technician must directly refill a reservoir provided in the housing structure. The dispensers typically include a delivery device, such as a dosing pump, and a device such as a lever or button for actuating the dosing pump. The dispensers may be vented or unvented.

The conventional dispensers depend on the continued maintenance and operability of the housing structure that is permanently affixed to the wall. In other words, if the housing structure, and particularly the dosing pump, is damaged or vandalized, the dispenser becomes inoperable and must be replaced. The conventional dispensers also depend on a supply system wherein additional liquid soap must be separately stored, transported, and loaded into the dispensers. This process entails unnecessary logistic and man power resources.

The present invention is an improvement over existing systems in that it provides a disposable self-contained dispenser with a significantly increased capacity as compared to standard dispensers, is relatively inexpensive, and does not depend on the separate storage and delivery of refill cartridges or bulk volumes of liquid soap or other type of viscous product.

OBJECTS AND SUMMARY OF THE INVENTION

Objects and advantages of the invention will be set forth in part in the following description, or may be obvious from the description, or may be learned through practice of the invention.

The present invention provides a self-contained viscous liquid dispenser. Although having particular usefulness as a liquid soap dispenser, the dispenser according to the invention is not limited to a liquid soap dispenser and may be utilized in any application wherein it is desired to dispense metered doses of a viscous liquid. For example, the dispenser may have particular usefulness as a shampoo dispenser, lotion dispenser, food product dispenser (i.e., catsup, mustard, or mayonnaise dispenser), or any other product dispenser for dispensing metered amounts of a viscous substance. The liquid dispenser will be described herein with reference to a soap dispenser for ease of explanation.

The viscous liquid dispenser includes a housing that may be formed of any suitable material. For example, the housing may be molded from relatively inexpensive plastic materials and may have any desired aesthetic shape. The housing also defines an integral sealed internal liquid reservoir. In other words, the liquid reservoir is not a separate component from the housing, such as a cartridge or the like. The housing may be comprised of wall members that give the dispenser its outward appearance and also define the internal liquid reservoir.

A dispensing pump mechanism is disposed at least partially within the reservoir. The pump mechanism has a delivery end that extends out of the reservoir which is actuated by a user to dispense the viscous liquid.

The dispenser also includes a mounting mechanism that is configured as an integral component of the housing. The mounting mechanism allows the dispenser to be detachably connected to complimentary mounting structure on a wall surface. In this way, the dispenser may be easily removed from the wall surface for disposal or recycling once the liquid has been depleted. A new liquid dispenser according to the invention is then attached to the wall surface.

In one embodiment of the invention, the housing comprises a substantially vertical back side that is configured to be placed adjacent to the wall surface. The mounting mechanism is configured in the back side. For example, if the housing is a molded component, the mounting mechanism is molded integral with the back side. The mounting mechanism may comprise a recess that is defined in the back side. The recess may be defined by side walls that have engaging structures defined thereon. These engaging structures interlockingly engage with complimentary structure provided on the wall mounting structure. The wall mounting structure may be, for example, a plate member or similar device that is relatively permanently affixed to the wall. In one embodiment of the engaging structure, the vertical side walls of the recess include at least one angled surface on each vertical side wall. These angled surfaces engage against complimentary angled surfaces on the mounting wall structure similar to a conventional dove-tail configuration. The housing is slidable in a generally vertical direction onto the wall mounting structure so that the angled surfaces of the mounting mechanism slide into engagement against the angled surfaces of the wall mounting structure. Once engaged, the angled surfaces prevent the dispenser from being pulled away from the wall mounting structure. A securing device may be provided on the back side of the housing to prevent relative sliding movement between the housing and the wall mounting structure upon engagement of the angled surfaces. This securing device may be, for example, a simple protrusion disposed on the back side of the housing that engages in a complimentary recess or divot defined in the wall mounting structure. In an alternate embodiment, the protrusion or a locking nub may be provided on the wall mounting structure to engage in a complimentary recess or divot formed in the housing recess.

In one particular embodiment of the invention, the wall mounting structure is made of a relatively hard, rigid material (i.e., a metal or hard plastic bracket) and may have at least one dimension (i.e., width or depth) that is greater than the corresponding dimension of the housing recess. The housing may be formed of a material, such as plastic, having an inherent degree of "play" or resiliency. In this manner, upon mounting the housing onto the wall mounting structure, the greater dimension component of the mounting structure will cause the corresponding portion of the housing recess to "bow" or flex so as to accommodate the over-sized wall mounting structure. This configuration provides for an extremely secure and tight engagement of between the housing and wall mounting structure that prevents the housing from wobbling or otherwise moving relative to the supporting wall. To a user, the housing will appear to be permanently bolted or otherwise mounted to the wall and there will be essentially no indication that the housing can be removed. Also, the housing cannot be pulled away or pried from the wall mounting structure without extreme force.

In one particularly useful embodiment, at least two spaced apart angled surfaces are provided on each vertical wall of the recess that engage against complimentary spaced apart angled surfaces on the wall structure. The spaced apart configuration of the angled surfaces maximizes the surface contact area between the housing and the wall mounting structure without significantly increasing the relative sliding distance between the members.

As mentioned, the housing structure is preferably formed from a relatively inexpensive molded plastic and may comprise separately molded components that are permanently affixed or adhered to each other. For example, the housing may include a front component that is formed separately from and adhered to a back component. It may be desired that the front and back components have different characteristics. For example, it may be desired that the back component is more rigid than the front component to provide enhanced structural support and rigidity to the dispenser mounted on the wall structure. This may be accomplished by simply making the back component thicker than the front component. The front and back components may be molded or otherwise formed from different types of materials.

It may also be desired to make at least a portion of the housing translucent or clear so that a maintenance technician can easily determine the remaining level of liquid within the reservoir. For example, a window may be provided in the housing. In one particularly useful embodiment, the housing includes a back component that is formed from a translucent material so that the entire volume of the reservoir is visible from the outside.

Any manner of actuator may be provided with the dispenser to allow the user to operate the pump mechanism. For example, in one embodiment, the actuator may comprise a panel member that contributes to the aesthetic appearance of the housing. The panel member may be hinged or otherwise movably connected to the housing member and lie in contact against a delivery end of the pumping mechanism. Upon the user depressing or moving the panel, the pumping mechanism is actuated so that a metered dose of the liquid is dispensed. In an alternate embodiment, the actuator may comprise a member, such as a decorative cap or the like, directly attached to the delivery end of the pump mechanism. In other words, the actuator need not be connected directly to the housing. Various embodiments of aesthetically pleasing actuators may be used in this regard.

The pump mechanism may include a pump chamber that is formed integral with the housing within the reservoir. For example, the housing may comprise a molded plastic component wherein a pump chamber is integrally molded on the interior of the housing. The pump chamber has a back end that is open to the reservoir section of the housing and a front end that is open to the outside of the housing. A pump cylinder is slidably disposed and retained in the chamber. The pump cylinder has a channel defined therethrough and a delivery end extending out of the front end of the chamber. The pump cylinder is retained within the chamber so that it cannot be pulled therefrom. An actuator is configured with the delivery end of the pump cylinder so that the device may be actuated by a user from outside of the housing. A valve mechanism is disposed in the delivery end of the pump cylinder and is configured to close upon the user releasing the actuator to prevent leakage or dripping of liquid from the pump cylinder.

In one embodiment, the pump cylinder is insertable into the pump chamber from its back end. The chamber includes retaining structure, such as a flange member or the like, at its front end to prevent withdrawal of the pump cylinder from the pump chamber through the front end. A cap member or like device is attached to the back end of the pump chamber once the cylinder has been inserted into the chamber. The cap member has an orifice defined therethrough for drawing liquid into the pump chamber. A check valve device, such as a shuttle valve, is disposed in the orifice to close the orifice upon actuation of the pump cylinder.

The valve mechanism disposed in the delivery end of the pump cylinder may comprise a flexible flap member that is movable to an open position by the pressure of the liquid being dispensed. Upon release of the actuator, the flap member automatically returns to a closed position and thus prevents undesired leakage or dripage of the liquid out of the delivery end of the pump cylinder. In one particularly useful embodiment, the valve mechanism comprises a plurality of flap members that define an opening therethrough in their open position, and seal against each other in their closed position.

The dispenser may also utilize a removable pump mechanism that is screwed or otherwise mated with the housing reservoir. For example, the pump mechanism may include a self-contained pump having a pump chamber housing, cap, or other suitable structure that is fitted to a bore defined through a housing wall so as to be in communication with the internal reservoir. Any type of conventional pump mechanism may be utilized in this regard. In this embodiment, the pump may be removed from the housing for subsequent re-use before disposing of the housing.

A vent path is defined into the reservoir to prevent drawing a vacuum therein. In a particularly desired embodiment, the vent is provided in a top surface of the housing structure. Since the housing structure is mounted in use upon a wall surface, there is little concern of the liquid leaking from the vent in the top surface. In other embodiments, the reservoir may be vented through the pump mechanism. However, venting through the pump mechanism may result in undesired leakage through the mechanism, particularly if the pump mechanism is disposed in the lower portion of the housing. Venting may also be accomplished through the valve mechanism in the delivery end of the pump cylinder.

Various embodiments of a top-mounted vent are contemplated for the dispenser. For example, a suitable vent mechanism mounted in the top wall of the housing may include a body member that slides into a fill port defined in the top of the housing after the reservoir has been filled with a viscous liquid or substance through the port. The vent body interlockingly and sealingly engages with the top wall of the housing in such a manner that, once inserted, the vent body cannot readily be removed without causing significant damage to the dispenser. The vent may include a spring mounted or other resiliently mounted plug, such as a ball, within the vent passage. This plug essentially seals the vent until a user actuates the pump mechanism resulting in a partial vacuum being drawn in the reservoir upon a dose of the viscous liquid being expelled from the dispenser. This vacuum causes the plug to be drawn downwards against the force of the spring or other resilient member to unseal the vent orifice until pressure equalized across the vent, whereupon the plug reseats.

A unique advantage of a dispenser according to the present invention is that the capacity of such a dispenser may be significantly increased without necessarily increasing the dispenser "packaging." The term "packaging" is understood to be the materials and structure required to render and maintain a given capacity (volume) dispensing "position." For example, with conventional cartridge refill dispensers (i.e., a flexible bag cartridge refill placed in a wall mounted housing), the "packaging" for initial set up or replacement of the dispenser includes the cartridge materials and wall mounted housing structure into which the cartridge must be subsequently placed. For conventional dispensers wherein a reservoir in the housing is refilled directly with the liquid product from a bulk storage source, the "packaging" includes the entire wall mounted housing structure as well as the bulk storage container. With the present invention, the "packaging" is essentially the disposable housing structure and integral pump mechanism. The ratio of weight of packaging (grams) to capacity (volume in liters) can be significantly decreased with the present dispenser as compared to conventional devices. This leads to increased economic benefits with respect to shipping, handling, storage, maintenance, etc.

It should be appreciated that the configuration and appearance of the housing is not a limiting feature of the invention. Also, the invention is not limited to the use of any particular type of materials or manufacturing process. Various embodiments of interlocking engagement structure between the back side of the housing and the wall mounting member are also within the scope and spirit of the invention. For example, the engaging structure may include bayonet type fasteners, or the like.

The invention will be described in greater detail below with reference to particular embodiments illustrated in the figures.

DETAILED DESCRIPTION

Figure 1:
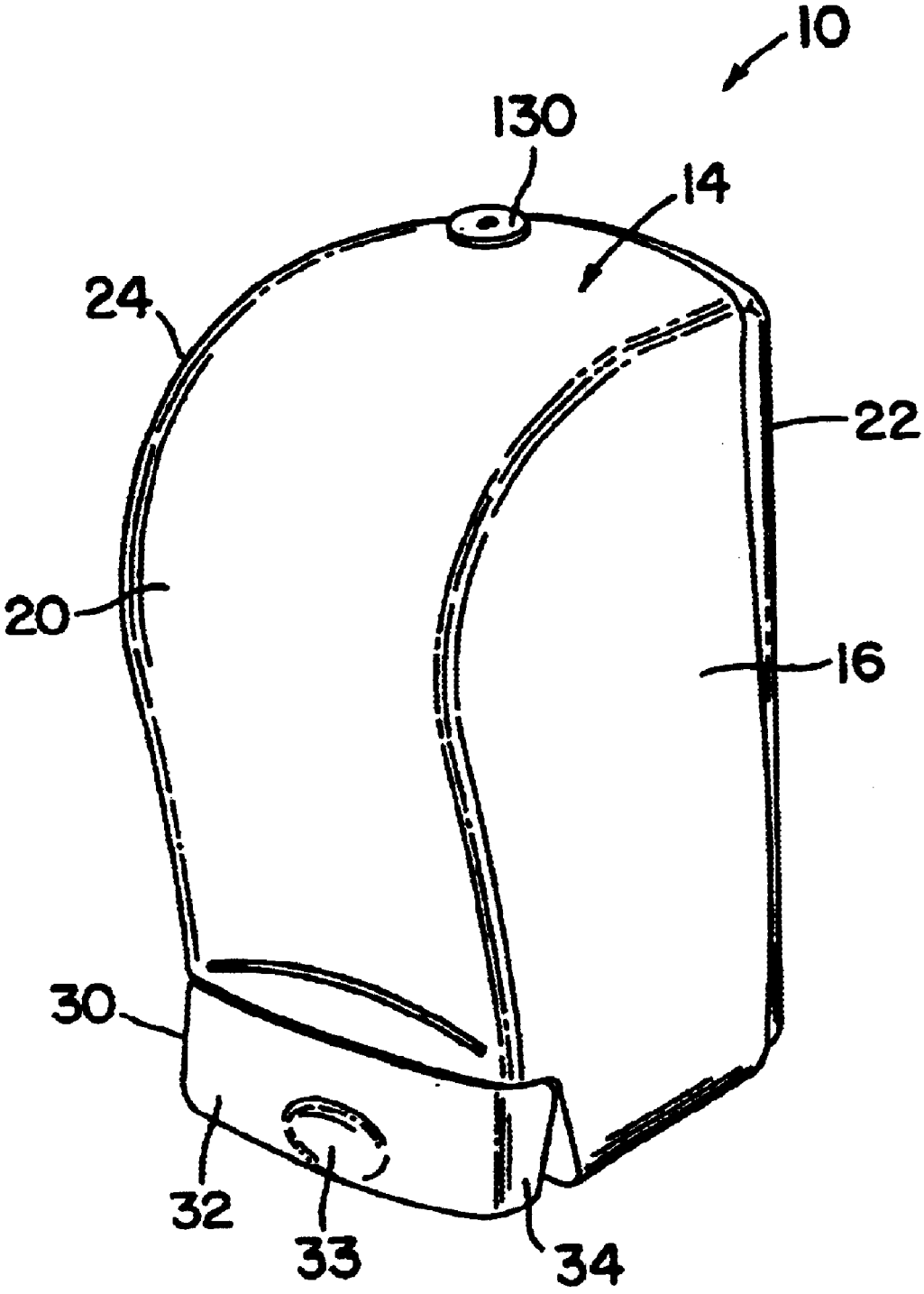
FIG. 1 is a perspective view of a dispenser according to the present invention.
Figure 2:
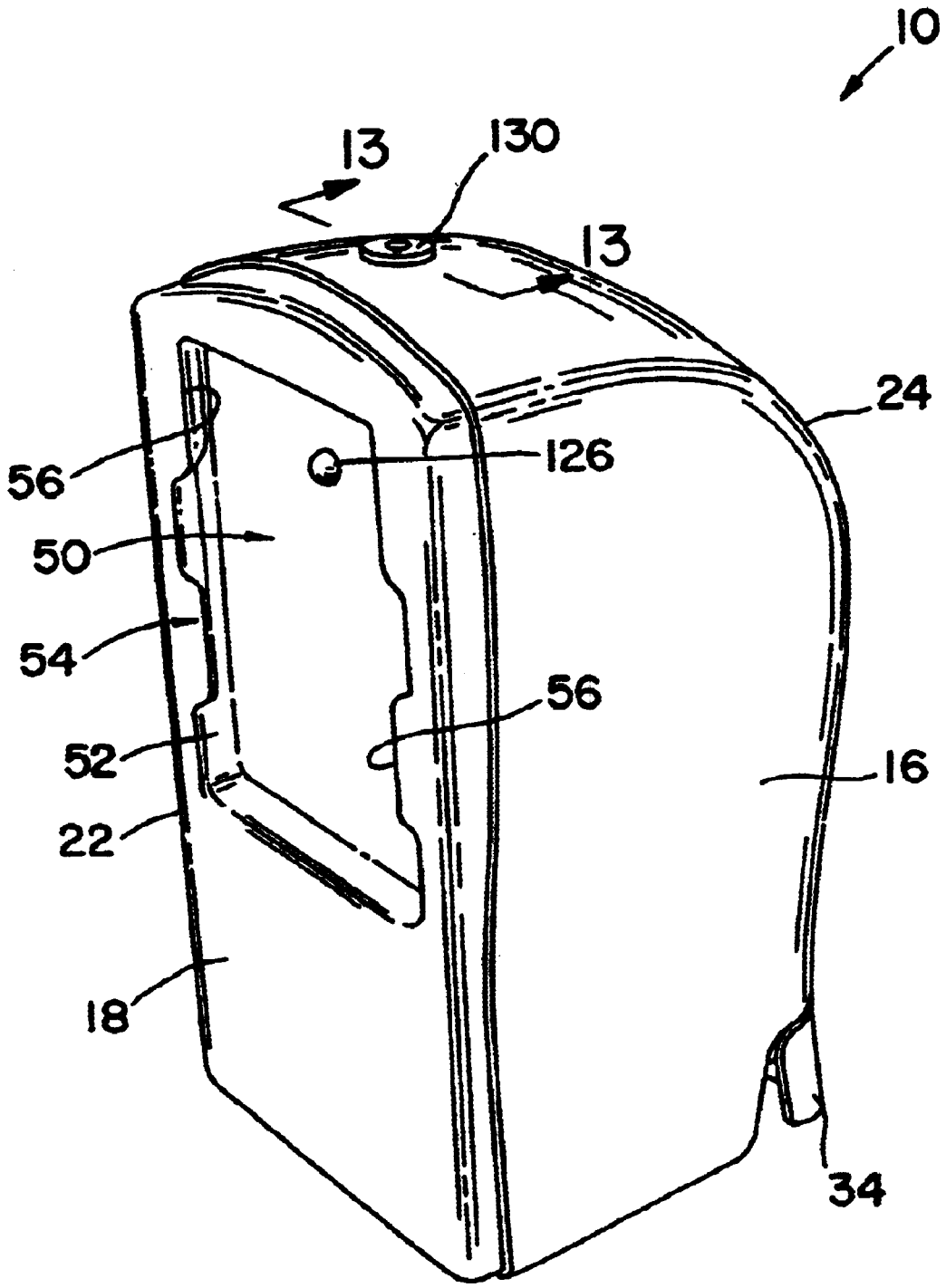
FIG. 2 is a perspective view of the back side of the dispenser illustrated in FIG. 1.

Reference will now be made in detail to embodiments of the invention, one or more examples of which are illustrated in the drawings. Each example is provided by way of explanation of the invention, not meant as a limitation of the invention. For example, features illustrated or described as part of one embodiment, may be used with another embodiment, to yield still a further embodiment. It is intended that the present invention include modifications and variations to the embodiments described herein.

A viscous liquid dispenser 10 according to the invention is illustrated generally in the figures. The dispenser 10 is illustrated and described herein as a liquid soap dispenser, which is a particularly useful embodiment of the present invention. However, it should be appreciated that the present invention is not limited to a dispenser for liquid soap, but has application in any environment wherein it is desired to dispense a metered amount of a viscous liquid from a dispensing unit.

Figure 4:
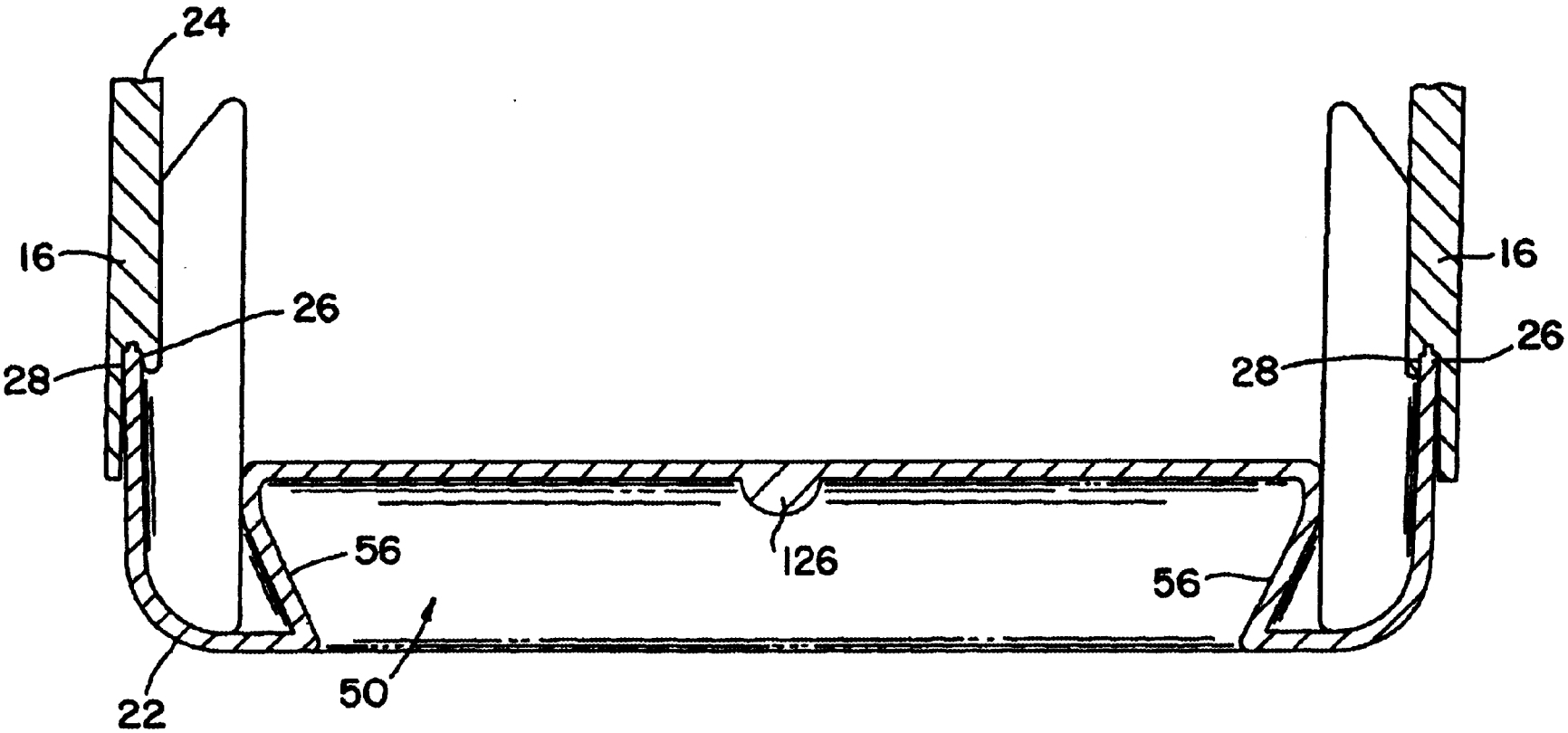
FIG. 4 is a cross-sectional view of the dispenser taken along the lines indicated in FIG. 3.
Figure 10:
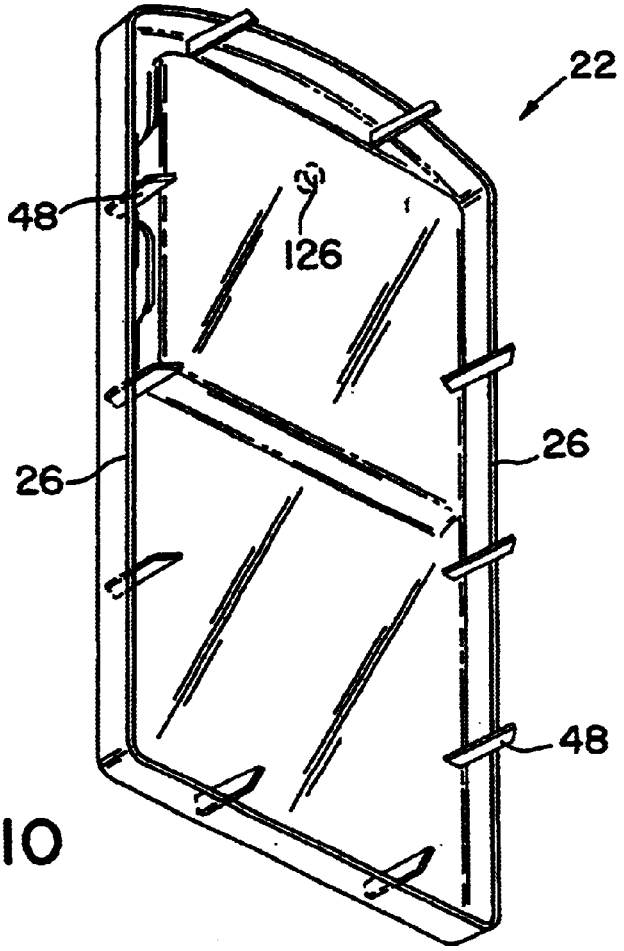
FIG. 10 is a perspective view of a back component of the dispenser housing.

The dispenser 10 includes a housing, generally 14. The housing 14 may contain side walls or members 16, a back side 18, and a front side 20. The housing 14 can take on any desired configuration and be formed from any number of components. In the illustrated embodiment, the housing 14 includes a front component 24 and a back component 22. The front and back components are separately manufactured and are permanently joined. It should be appreciated that the components may be manufactured from any desired material. In a preferred embodiment, the dispenser 10 is a disposable item and the housing 14 is molded from a relatively inexpensive plastic material. Referring particularly to FIG. 10, the back component 22 may be molded from a clear or translucent plastic and includes side edges 26 and alignment tabs 48. The tabs 48 align the back component 22 relative to the front component 24 and the side edges 26 fit into correspondingly sized recesses 28 (FIG. 4) defined in the side walls 16 of the front component 24. The back component 22 is permanently joined to the front component 24 by adhesives, welding, or any other relatively permanent attaching means.

The housing 14 defines an internal liquid reservoir 68 within the internal volume thereof. In the illustrated embodiment, the liquid reservoir 68 includes essentially the entire volume defined by the front component 24 and back component 22. Although not illustrated, it should be understood that any number of internal structural members, such as baffles or the like, may be included within the reservoir 68. It should be understood that the housing 14 thus also serves as a closed or sealed reservoir and the dispenser 10 cannot be opened by the maintenance technician. A desired amount of viscous liquid, for example soap, is pre-loaded into the dispenser 10 prior to the dispenser being delivered to its point of use.

Applicants have found that it may be desired for the back component 22 of the housing 24 to be more rigid than the front component 24. One way of achieving this feature is to simply mold the back component 22 with a thickness greater than that of the front component 24. As will be explained in greater detail below, the dispenser 10 is mounted onto a supporting wall surface by means of an internal mounting mechanism configured on the back side 18 of the housing 14. A more rigid back component 22 aids in mounting the dispenser 10. It has also been found that, if the front and back components are molded from a resilient plastic material, once the dispenser is empty, the back component 22 has enough "give" to enable the dispenser 10 to be easily removed from the supporting wall structure.

A dispensing pump mechanism, generally 88, is disposed at least partially within the reservoir 68. The pump mechanism 88 has a delivery end 90 that extends out of the housing or reservoir 68. The pump mechanism 88 is configured to dispense a metered amount of the viscous fluid upon a user actuating the pump mechanism. It should be appreciated that any number of conventional and well known pump devices may be utilized in the dispenser 10. The pump mechanism 88 illustrated in the drawings is one embodiment of a particularly well suited mechanism.

It is also within the scope of the invention to configure a removable pump mechanism with housing 24. For example, any manner of conventional pump may be screwed or otherwise mated with the housing 24 so as to be in communication with the reservoir 68. For example, such a pump mechanism may include a self-contained pump having a pump chamber housing, cap, or other suitable structure that is fitted to a bore defined through a front wall of the housing 24 so as to be in communication with the internal reservoir 68. Installation of the pump could take place at the point of use of the dispenser. For example, the pump from a spent dispenser may be removed from the housing and immediately installed into a replacement housing. A removable plug or breakable seal could be used to cover the housing port through which the pump is inserted until.

Figure 5:
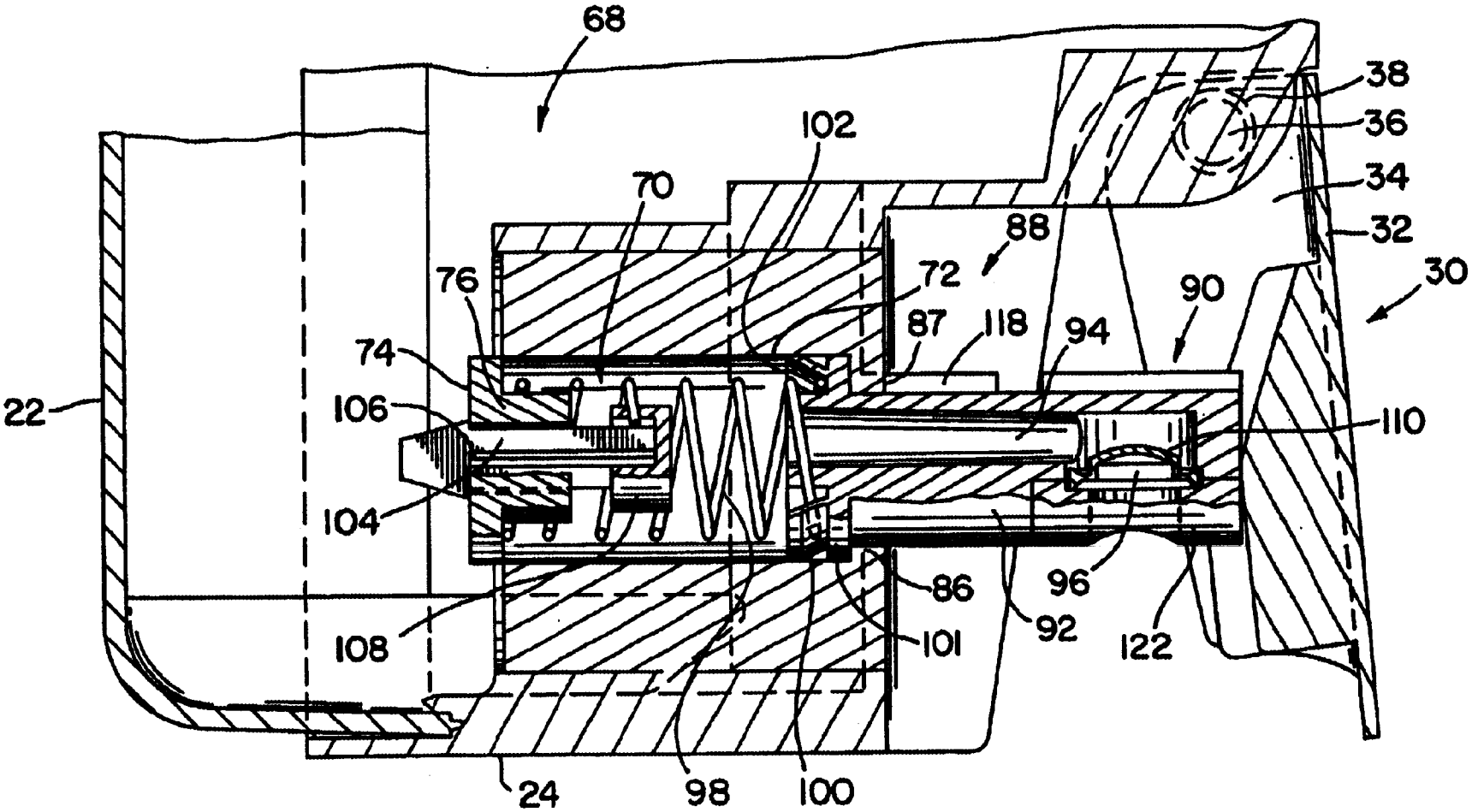
FIG. 5 is a cross-sectional view of the pump mechanism of the dispenser taken along the lines indicated in FIG. 3.
Figure 6:
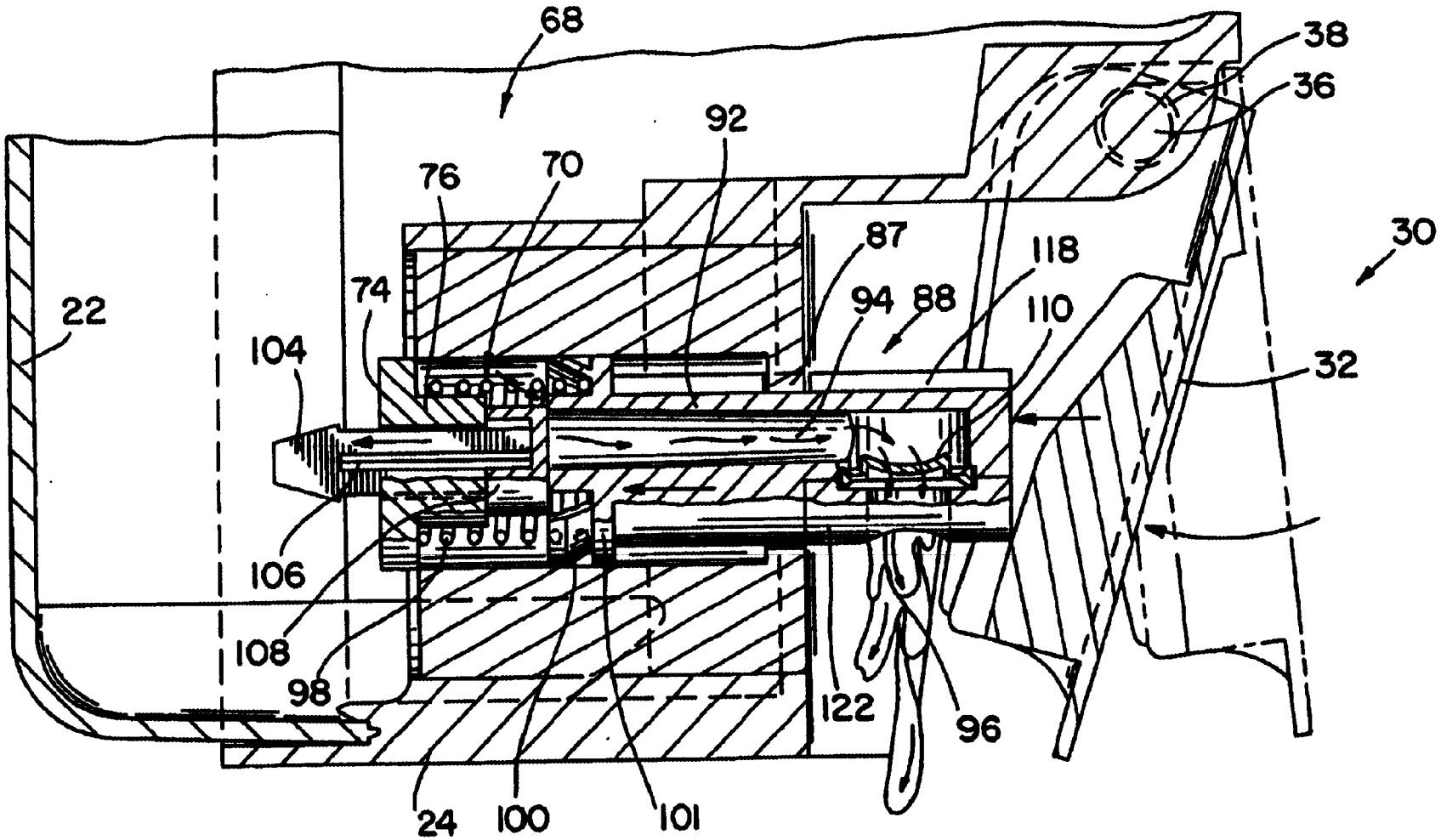
FIG. 6 is a cross-sectional operational view of the pump mechanism.
Figure 7:
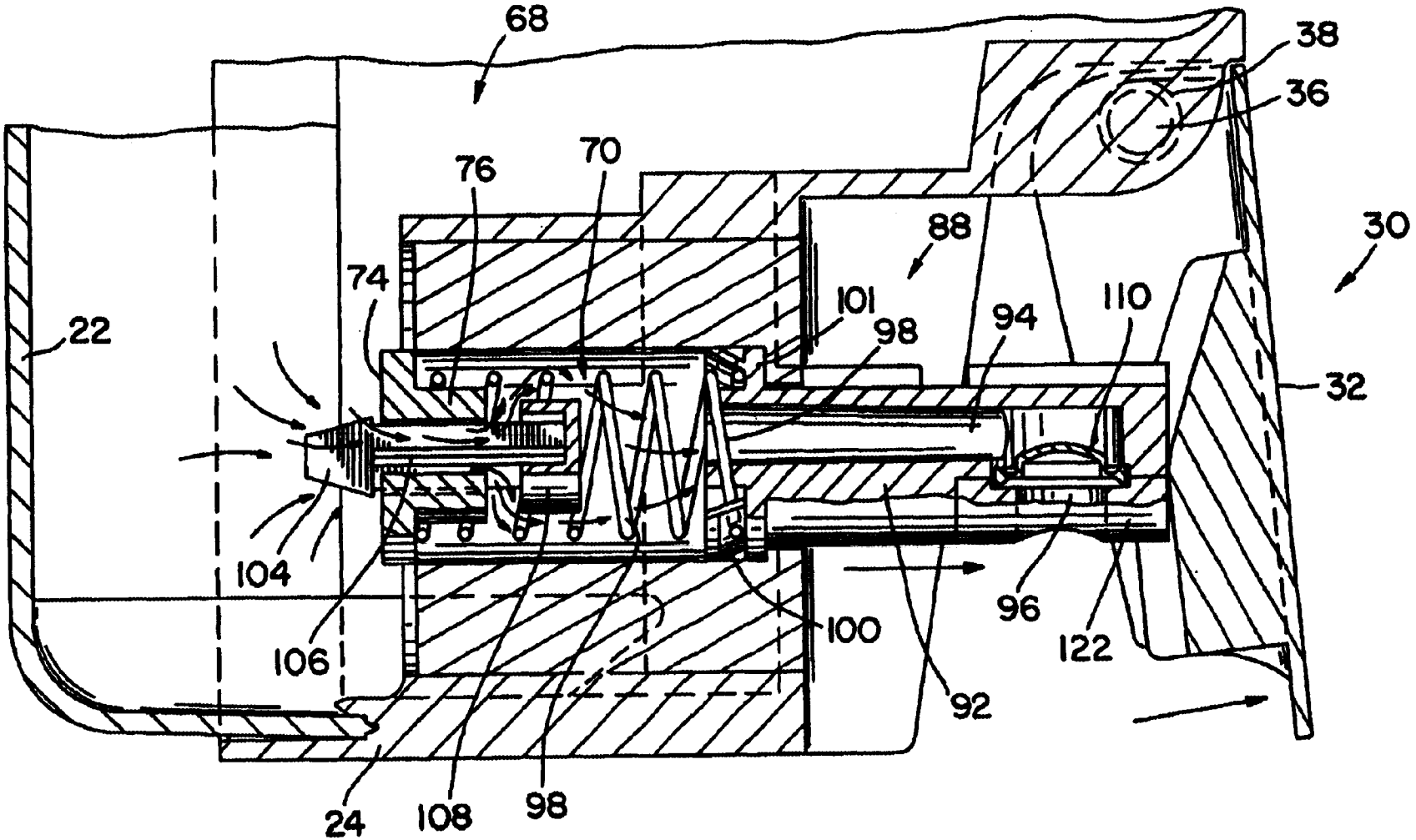
FIG. 7 is a cross-sectional operational view of the pump mechanism.

Referring to an embodiment of the pump mechanism shown in FIGS. 5 through 7, the pump mechanism 88 includes a cylinder 92 that is slidable within a chamber 70. The volume of chamber 70 determines the metered dose of liquid dispensed upon each actuation of the pump. The chamber 70 may be formed by any internal structure of the housing 14. It may be preferred that the chamber is defined by structure integrally molded with the front component 24 of the housing 14. In the illustrated embodiment, the chamber 70 is defined by chamber walls 72 as a generally cylindrical chamber. The cylinder 92 includes a channel 94 defined longitudinally therethrough. The channel 94 is in communication with the interior of the pump chamber 70 through an end wall of the cylinder. The delivery channel 94 terminates at a dispensing orifice 96 defined in the front end of the cylinder 92.

The cylinder 92 sealingly engages against the chamber walls 72 by any conventional means. For example, a flange or piston 101 may be disposed at the rear end of the cylinder 92 for sealing engagement against chamber wall 72. In an alternative embodiment, O-rings 116 (FIG. 8*a*) may be provided around the piston 101. The piston 101 pressurizes the chamber 70 and ensures that the viscous liquid contained within the chamber is dispensed through the delivery channel 94 upon actuation of the cylinder 92 and does not simply move from one end of the pump chamber 70 to the other upon movement of the cylinder.

The pump cylinder 92 is biased within the chamber 70 by way of, for example, a spring 98. Other resilient devices, including a leaf spring, spring washer, and the like, may be utilized for this purpose. In the illustrated embodiment, the spring 92 is seated within a recess 102 defined by a flared flange 100, as particularly illustrated in FIGS. 5 through 7. The opposite end of the spring 98 is fitted around a cylindrical extension 76 of an end cap 74. The end cap 74 is permanently fixed to the structure defining the pump chamber 70 after the cylinder 92 has been inserted into the pump chamber.

Structure is also provided to ensure that the cylinder 92 cannot be pulled from the front end of the chamber 70. In the illustrated embodiment, this structure corresponds to a flange portion of the front wall 86 of the chamber 70. As illustrated in FIG. 5, the flange portion 86 of the wall engages against the piston 101 of the pump cylinder 92.

A check valve device 104 is configured with the pump mechanism 88 to ensure that the viscous liquid within the pump chamber 70 is not pushed out of the chamber 70 upon movement of the cylinder 92 within the chamber 70. In the illustrated embodiment, the check valve device 104 is a shuttle type check valve having radially extending arms 106. The shuttle valve is slidably disposed within an opening defined through the end cap 74. The space between the radial arms 106 is open to the reservoir 68 so that the liquid can flow from the reservoir 68 into the pump chamber 70 upon movement of the cylinder to the forward end of the pump chamber 70, as illustrated in FIG. 7. A cap 108 is provided on the forward end of the shuttle valve 104 disposed within the pump chamber 70 to ensure that the opening in the end cap 74 is sealed upon actuation of the pump. The cap 108 seals against the end face of the end cap 74.

Operation of the pump mechanism 88 is particularly illustrated in FIGS. 6 and 7. To dispense a metered amount of the viscous liquid contained within the reservoir 68, a user actuates the pump mechanism 88 by way of an actuator 30. The actuator 30 will be described in greater detail below. Upon depressing the actuator 30, the pump cylinder 92 is moved rearward within the pump chamber 70. Pressure of the viscous liquid within the chamber 70 forces the shuttle valve 104 to close and the viscous liquid contained within the chamber 70 is directed into the delivery channel 94 defined longitudinally within the pump cylinder 92. The viscous liquid is expelled through the dispensing orifice 96, as particularly illustrated in FIG. 6. Upon release of the actuator 30, the spring 98 forces the pump cylinder to return to the position illustrated in FIG. 7. This action unseats the shuttle valve 104 and draws viscous liquid back into the pump chamber 70, as particularly illustrated in FIG. 7.

Figure 13:
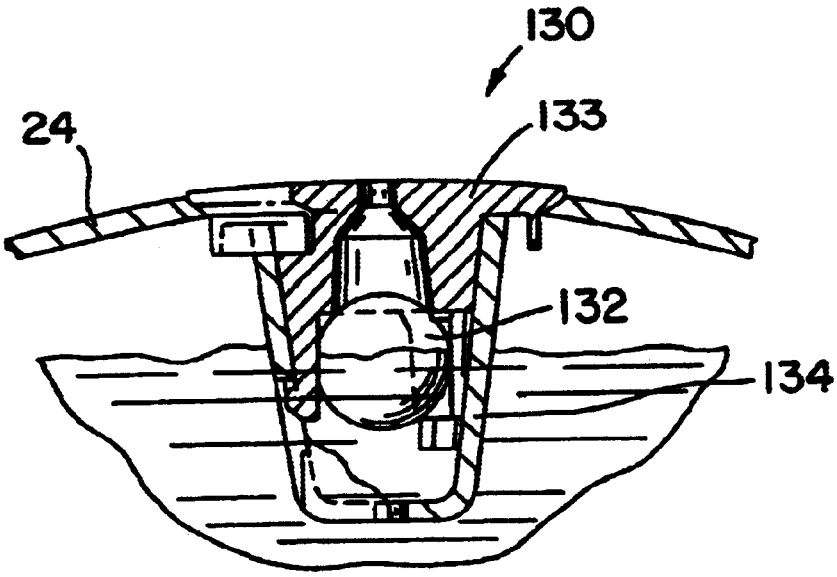
FIG. 13 is a cross-sectional view of the vent valve taken along the lines indicated in FIG. 2.

So as not to draw a vacuum within the reservoir 68, the reservoir is vented. This venting may be accomplished by various means. For example, the reservoir 68 could be vented directly through or around the cylinder 92. However, this may not be a desired embodiment since fluid would tend to leak out from around the cylinder. One preferred venting method as illustrated in the figures is to vent the top of the housing 14, for example by way of a conventional vent valve 130 disposed through the top surface of the housing 14. The vent valve 130 is particularly illustrated in FIG. 13 and utilizes a ball 132 seated within a ball cage 134. The ball 132 seats against and seals an opening provided in a top member 133 upon an overfill condition of the viscous liquid, as illustrated in FIG. 13, or upon the housing 14 being overturned during shipment or the like. Once the dispenser is hung on a wall surface for subsequent use, the ball 132 falls within the ball cage 134 to open the vent valve 130. Sealing of the ball 132 may further be assisted by a spring.

Figure 14:
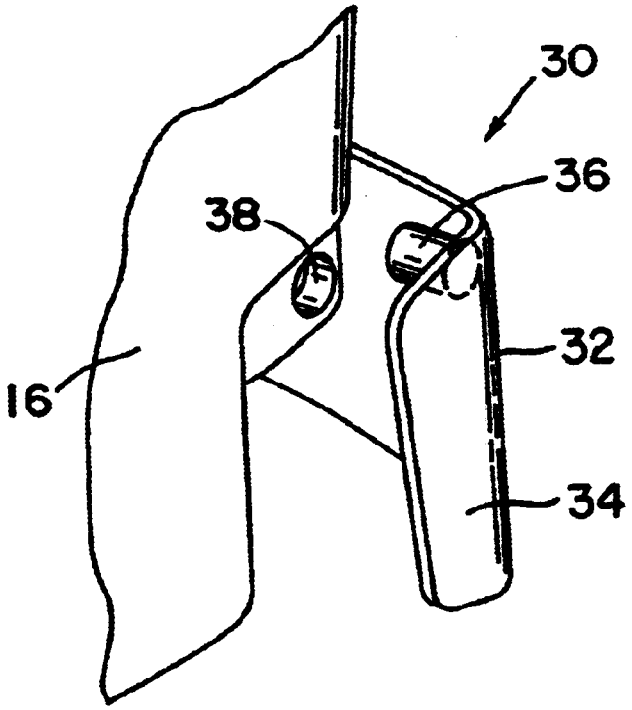
FIG. 14 is a an enlarged perspective view of the panel member actuator attached to the pump housing.

As mentioned, the pump mechanism 88 is operated by a user depressing an actuator 30. The actuator 30 may be any member configured to move the pump cylinder 92. In one embodiment illustrated in the figures, the actuator 30 is defined by a panel member 32 that adds a distinctive aesthetically pleasing look to the housing 14. The panel member 32 includes side walls 34 having inwardly disposed protrusions 36 (FIG. 14) that engage within correspondingly sized divots or recesses 38 provided in the sides 16 of the housing 14. A channel member 40 (FIG. 3) may be provided on the inner face of panel member 32 to positively engage against the front end of the pump cylinder 92. A depression 33 may be defined in the front face of panel member 32 to indicate to a user the proper location for depressing the actuator.

Figure 15:
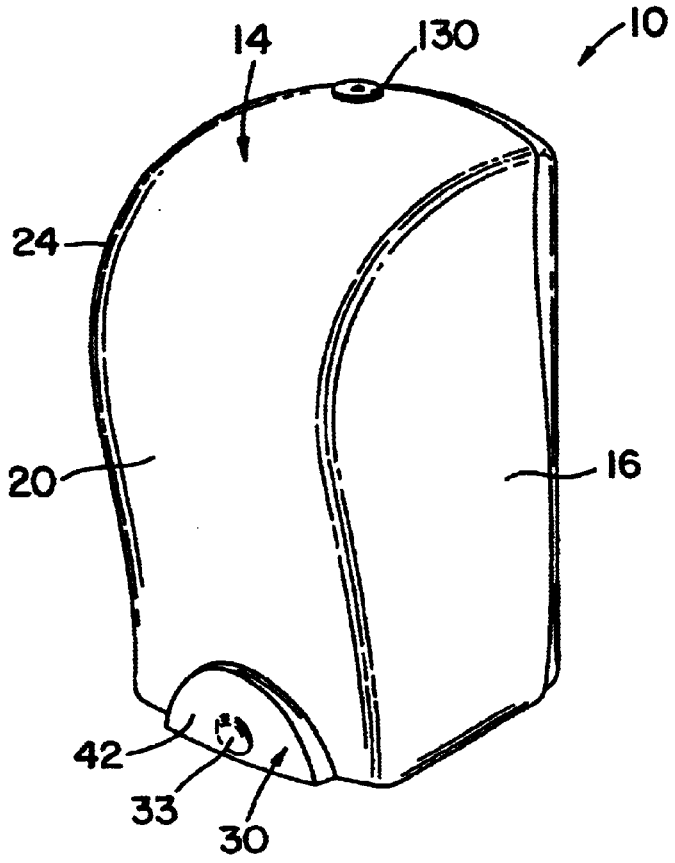
FIG. 15 is a perspective view of an alternative embodiment of the dispenser.
Figure 16:
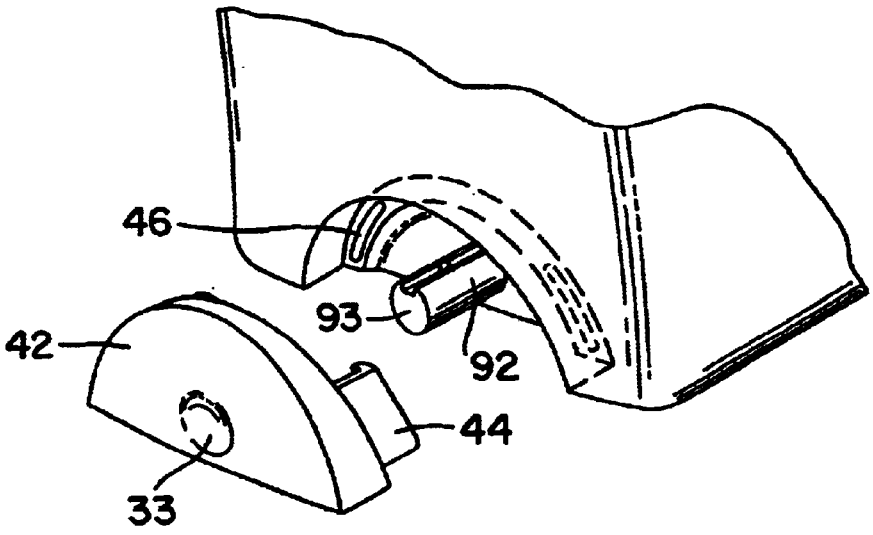
FIG. 16 is an enlarged component view of the actuator used with the dispenser illustrated in FIG. 15.
Figure 17:
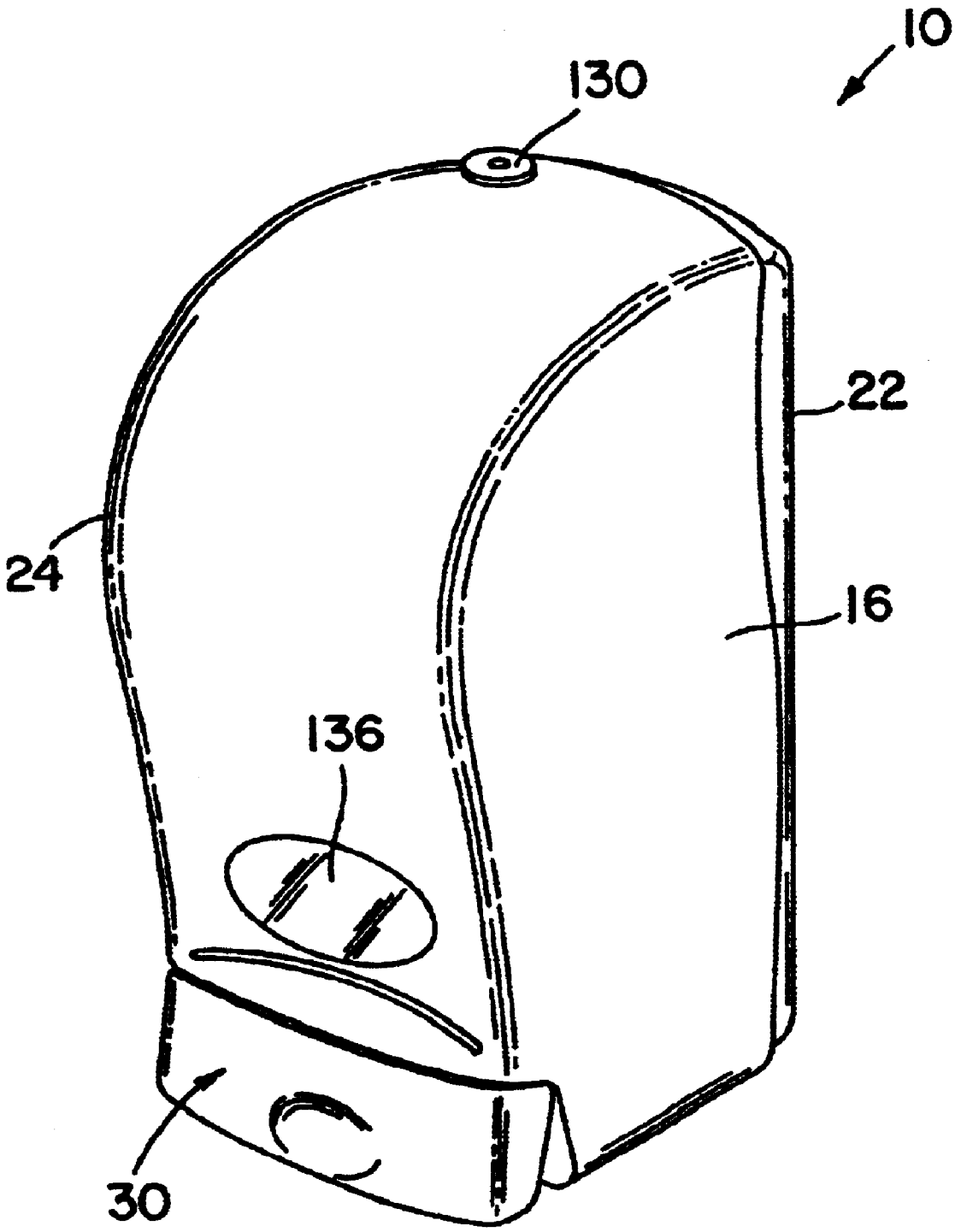
FIG. 17 is a perspective view of an alternative embodiment of the dispenser particularly illustrating a window feature for determining the level of liquid within the dispenser.

It should be appreciated that the actuator may take on any configuration or aesthetically pleasing shape. In an alternate embodiment illustrated particularly in FIGS. 15 and 16, the actuator 30 is defined by a cap 42 that is attached directly to the front face 93 of the pump cylinder 92. This attachment may be provided by adhesives, mechanical interlocking devices, or the like. Arms 44 may slidably engage within recesses 46 defined in the pump housing 14 to ensure proper alignment and to provide rigidity to the structure.

Figure 8A:
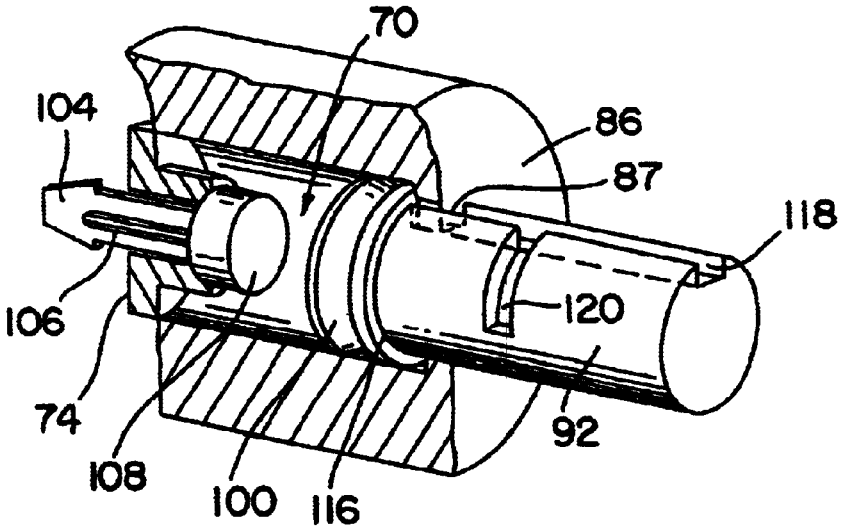
FIG. 8*a* is partial perspective and cut-away view of the pump mechanism particularly illustrating the check valve device.
Figure 8B:
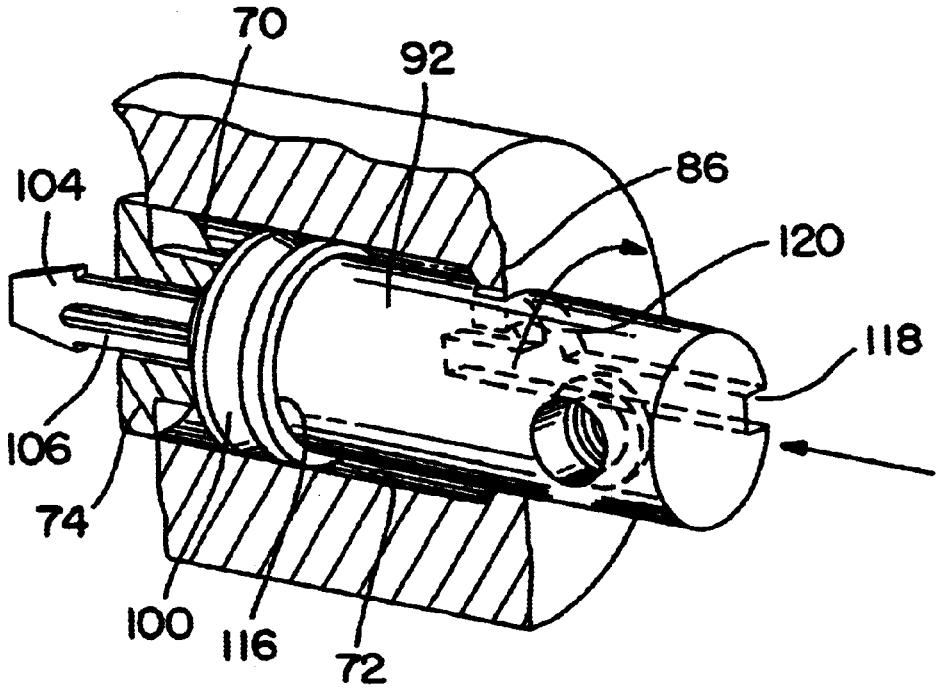
FIG. 8*b* is a partial perspective and cut-away view of the pump mechanism particularly illustrating the locking feature thereof.

FIGS. 8*a* and 8*b* illustrate a locking characteristic of the pump cylinder 92 that is particularly useful during shipment of the dispensers 10. The pump cylinder 92 may include a longitudinal channel 118 defined in the top thereof. A tab portion 87 of the pump chamber front wall member 86 is disposed within the longitudinal channel 118. In this way, the pump cylinder 92 is prevented from rotating upon actuation and release thereof. A partial circumferential channel 120 is defined in the pump cylinder 92, as particularly illustrated in FIG. 8*a*. The circumferential channel 120 is defined along the pump cylinder 92 at a location corresponding to the completely depressed or actuated position of the cylinder 92 within the chamber 70, as illustrated in FIG. 6. For shipment of the dispensers 10, the pump cylinder 92 may be depressed and then rotated so that the tab 87 is engaged within the circumferential channel 120, as particularly illustrated in FIG. 8*b*. In this configuration, the pump cylinder 92 is locked in position and cannot move within the chamber 70 until the pump cylinder is rotated back into the position illustrated in FIG. 8*a*. This procedure would be accomplished by the maintenance technician prior to attaching the actuator 30 and mounting the dispenser 10 onto a supporting wall surface.

It may be desired to include a valve mechanism within the dispensing orifice 96 of the pump cylinder 92 to prevent leakage of viscous liquid or soap from the dispenser. Any manner of sealing valve may be utilized in this regard. Applicants have found that a particularly useful valve mechanism 110 is the type of valve illustrated in FIGS. 9*a* and 9*b*. This valve 110 includes a flange member 113 used to seat the valve 110 within the delivery and of the pump cylinder 92, as particularly illustrated in FIGS. 5 through 7. The valve includes at least one, and preferably a plurality, of resilient flaps 112 defining an opening 114 therethrough. The flaps 112 seal against themselves when the valve 110 is positioned within the pump cylinder 92 in the orientation illustrated in FIGS. 5 through 7. Upon actuation of the pump cylinder 92, liquid pressure forces the resilient flaps 112 to open to dispense the liquid from the pump cylinder 92, as particularly illustrated in FIG. 6. A separate cap member 122 may be used to secure the valve 110 in position with respect to the dispensing orifice 96, the cap member 122 includes its own opening aligned with the dispensing orifice. The cap member 122 may comprise a press fit element or may be permanently adhered, welded, etc., to the pump cylinder 92.

The valve 110 also tends to vent the pump chamber 70 as the cylinder 92 moves back to its rest position after being actuated. As a vacuum is drawn in the chamber 70, the resilient flaps separate slightly and are drawn towards the chamber 70 thus defining a vent path. Once the chamber is vented, the flaps close and seal against each other.

Figure 9A:
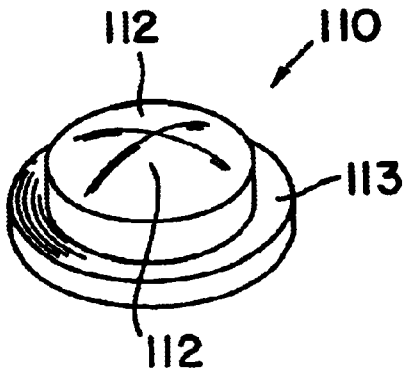
FIG. 9*a* is a perspective view of a valve mechanism incorporated in the pump cylinder.
Figure 9B:
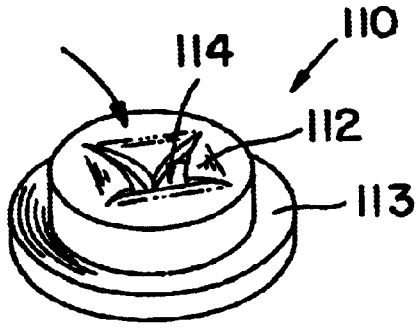
FIG. 9*b* is an operational perspective view of the valve mechanism of FIG. 9*a*.
Figure 11:
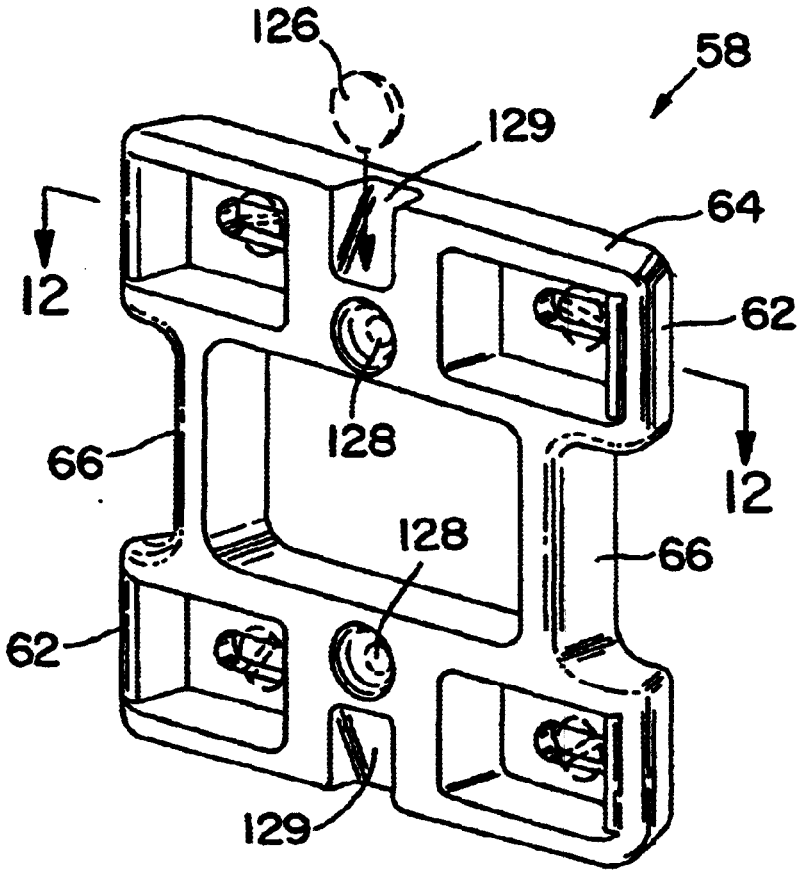
FIG. 11 is a perspective partial operational view of a wall mounting bracket for mounting the dispenser.

The valve 110 illustrated in FIGS. 9*a* and 9*b* is conventionally known in the art as a bifurcating valve and may be obtained from LMS Corporation of Michigan.

Figure 3:
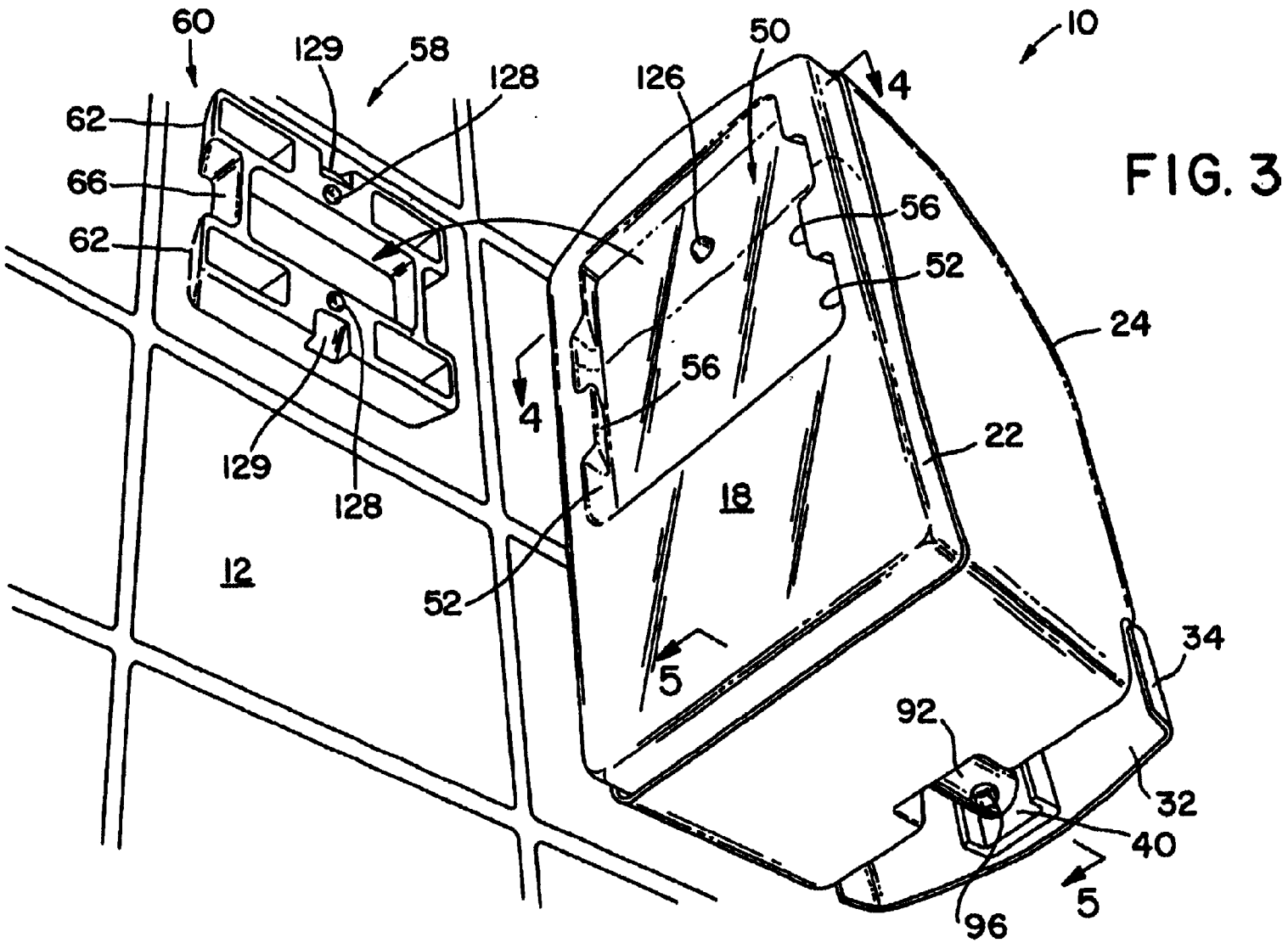
FIG. 3 is an alternative perspective view of the dispenser according to FIG. 1 and complimentary wall mounting structure.

The dispenser 10 according to the invention also includes an integrally formed mounting mechanism configured as an integral component of the housing 14. This mounting mechanism allows the dispenser 10 to be detachably connected with complimentary mounting structure, generally 58, provided on a wall surface 12 (FIG. 3). In one embodiment according to the invention, the mounting mechanism is defined as an integrally molded feature of the back side 18 of the dispenser 10. This feature is not limited to any particular type of structure, and includes any suitable type of connector or engagement structure for detachably mounting the housing to complimentary mounting structure provided on a wall surface 12. It is desirable that the mounting mechanism structure be encircled by a "border" of the back side 18 of the housing, as seen for example in FIG. 3, so that upon mounting the housing 14 against a wall surface 12, the border section of the back side 18 is directly against the wall surface 12. With this configuration, the mounting mechanism is not visible from any angle and there is essentially no space between the housing 14 and the wall surface 12 through which a potential vandal would be tempted to insert a prying device.

Figure 12:
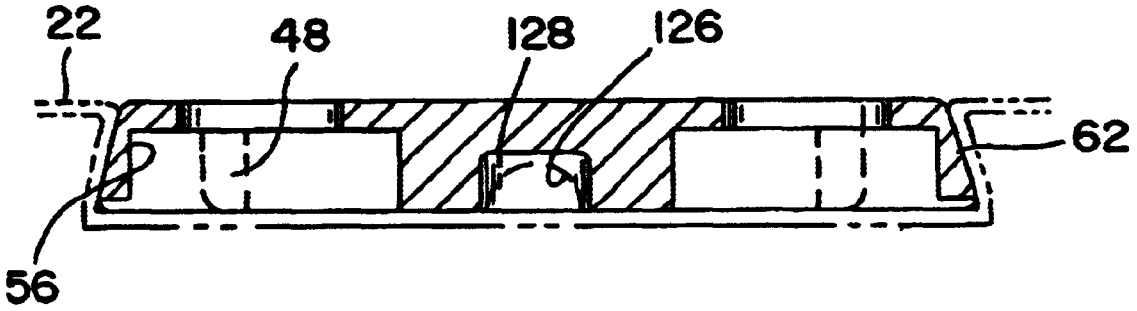
FIG. 12 is a cross-sectional view of the wall mounting bracket taken along the lines indicated in FIG. 11.

In the illustrated embodiment, the integral mounting mechanism feature includes a recess 50 is molded into the back side 18. The recess 50 is defined by generally vertical side walls 52. Engaging structure is provided along the side walls 52 for engaging against or with complimentary structure provided on the wall mounting structure 58, as discussed in greater detail below. In the illustrated embodiment, the engaging structure is defined by angled surfaces 56 defined along the vertical walls 52. The angled surfaces 56 engage against complimentary angled surfaces 62 defined on the wall mounting structure 58, as can be particularly seen in FIGS. 3 and 12. In the illustrated embodiment, at least two angled surfaces 56 are provided and are separated by a section of vertical wall 52. The two angled surfaces 56 engage against angled surfaces 62 of the wall mounting structure 58. In order to attach the dispenser 10 to the wall mounting structure 58, the maintenance technician simply positions the dispenser 10 against the wall mounting structure 58 such that the angled surfaces 56 are vertically disposed between the corresponding angled surfaces 62 of the wall mounting structure. Then, the maintenance technician simply slides the dispenser 10 in a vertical direction so that the angled surfaces 56, 62 engage, as particularly illustrated in FIG. 12. In this interlocking configuration, the dispenser cannot be pulled away from the wall mounting structure 58. The double angled surface 56 configuration provided on each vertical wall 52 is particularly useful in that it provides an increased interlocking surface area of angled surfaces with relatively little vertical movement required between the dispenser 10 and the wall mounting structure 58 as compared to a single angled surface 56 having the same longitudinal surface area.

In one particular embodiment of the invention, the back wall 18 of the housing may be formed of a material, such as plastic, having an inherent degree of "play" or resiliency. The wall mounting structure 58 on the other hand may be made of a relatively hard, rigid material (i.e., a metal or hard plastic bracket) and may have at least one dimension (i.e., width or depth) that is greater than the corresponding dimension of the housing recess 50. For example, the width of the mounting structure 58 at the angled surfaces 62 may be slightly greater than the corresponding mating width portion of the recess 50 defining the angled surfaces 56. In this manner, upon mounting the housing onto the wall mounting structure, the greater dimension component of the mounting structure will cause the corresponding portion of the housing recess to "bow" or flex so as to accommodate the over-sized wall mounting structure. This configuration provides several advantages. An extremely secure and tight engagement between the housing and wall mounting structure is provided that prevents the housing from wobbling or otherwise moving relative to the supporting wall. To a user, the housing will appear to be permanently bolted or otherwise mounted to the wall and there will be no indication that the housing can be removed. As mentioned above, the recess desirably may be completely encircled within a border portion of the back wall so that it is not visible from any angle upon mounting the housing onto the supporting wall. The housing back wall would appear to be directly flush against the supporting wall with a minimum uniform separation being defined completely around the back wall. Also, the housing cannot be pulled away or pried from the wall mounting structure without extreme force.

Once the dispenser 10 has been properly located on the wall mounting structure 58, it is desirable to include a securing device to indicate to the technician that the dispenser 10 has been properly positioned and to prevent removal of the dispenser 10 without a concerted effort. In the embodiment illustrated, the securing device comprises a protrusion 126 extending from the back side 18 of the housing within the recess 50. The protrusion 126 slides up a ramp surface 129 defined in the mounting structure 58 and snaps into a correspondingly sized divot 128 disposed adjacent to the ramp surface 129. The wall mounting structure 58 may comprise any manner of suitable attaching structure. In the illustrated embodiment, the wall mounting structure 58 is defined by a plate member 64 that is attached to the wall surface 12, for example by screws, adhesives, or the like. The wall mounting structure 58 serves simply to provide an interlocking engagement device for the dispenser 10. It should be appreciated that any manner of interlocking engaging configurations may be provided for detachably connecting the dispenser 10 to complimentary wall structure provided on a supporting wall. For example, relatively simple bayonet type fasteners, spring loaded latches, and the like, may be provided in this regard. A desirable feature of the invention is that the entire dispenser 10 is disposable and, thus, relatively simple yet reliable engagement devices are preferred. It has been found that the double angled surface configuration as illustrated and described herein is particularly useful in this regard.

Figure 19:
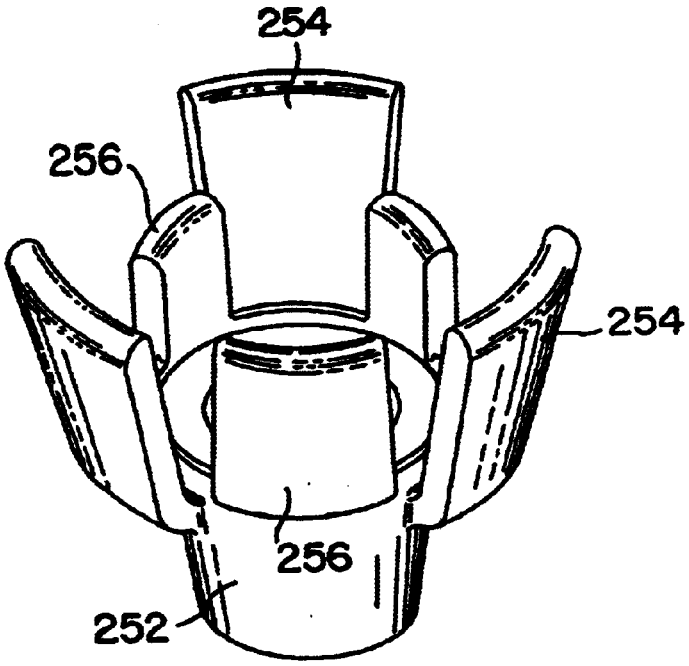
FIG. 19 is a perspective view of the lower portion of the body member for the vent mechanism of FIG. 18.

It may also be desired to provide means for the maintenance technician to determine the level of viscous liquid within the dispenser. In this regard, as discussed above, a portion of the housing 14 may be formed from a translucent or clear material. In the embodiment illustrated particularly in FIG. 1, the entire back component 22 is formed from a translucent or clear material so that the service or maintenance technician can view the remaining liquid level from the side of the dispenser. In an alternative embodiment illustrated in FIG. 19, a window 136 of clear or translucent material may be provide anywhere in the housing 14, preferably near the bottom portion of the housing, to provide the maintenance technician with the capability of viewing inside the reservoir to determine the remaining amount of liquid therein.

As mentioned, the unique structure and configuration of the housing with its internal reservoir and integrally formed wall mounting recess allows for a dispenser according to the present invention with a capacity that may be significantly increased without necessarily increasing the dispenser "packaging" (as defined above). For example, a 2.5 liter capacity dispenser in accordance with the invention is presently contemplated. It is anticipated that the dispenser packaging (housing and integrated pump mechanism) will weigh only about 250 grams. Thus, for maintaining and servicing a 2.5 liter dispensing "position," only about 250 grams of materials is necessary. On the other hand, if the same volume conventional cartridge or direct refill dispenser would need replacement due to vandalism, inoperative pump, etc., the combined weight for the housing and refill materials would be substantially greater. For the 2.5 liter capacity dispenser according to the invention, a weight (grams) to volume (liters) ratio is about 100:1. Applicants believe this to be a significant improvement over conventional refill dispensers (either cartridge refills or direct refill of a housing from a bulk storage container). For dispensers according to the invention with a greater capacity, for example a 5 liter dispenser, it is believed that the increase in packaging weight is not be a linear function and, thus, the weight to volume ratio will be reduced as capacity increases.

Thus, dispensers of various volume capacities can be designed according to the invention wherein the ratio of packaging weight in grams to volume capacity in liters is generally not greater than about 120:1, and is preferably about 100:1 or less. In one particularly useful embodiment of a 2.5 liter capacity dispenser, the ratio is about 100:1.

It should be appreciated that dispensers according to the invention are not limited in their size so long as the mounting mechanism between the housing and wall mounting structure is structurally sufficient to support the weight of the filled housing.

FIGS. 18 through 24 illustrate alternate embodiments of a vent mechanism that may be utilized in a dispenser according to the present invention. As with the vent 130 shown in FIG. 13, these vents prevent a vacuum from being drawn in the reservoir 68 by equalizing pressure between the reservoir and the surrounding environment. Referring to FIGS. 19 through 22, one particular vent mechanism 230 is configured to be disposed through an opening 238 in the upper wall 232 of the housing. This opening 238 may also serve as a fill port for initially filling the reservoir 68. The vent mechanism 230 includes a body, generally 250, that interlocking and sealingly engages with the wall 232. In the embodiment illustrated, the body 250 is inserted through the opening 238 and subsequently automatically engages against the inner surface 236 of the wall 232 so that the vent mechanism 230 cannot thereafter be pulled from the housing.

The vent body 250 in the shown embodiment includes an upper body portion 260 and a lower body portion 252. These portions may be separately molded or 20 formed and subsequently joined, for example at a ledge 257 as particularly seen in FIG. 18. The portions may be joined by any conventional means, including adhesives, ultrasonic welds, etc. The portions may also be formed as a single integral unit, for example as a single molded body component.

Figure 20B:
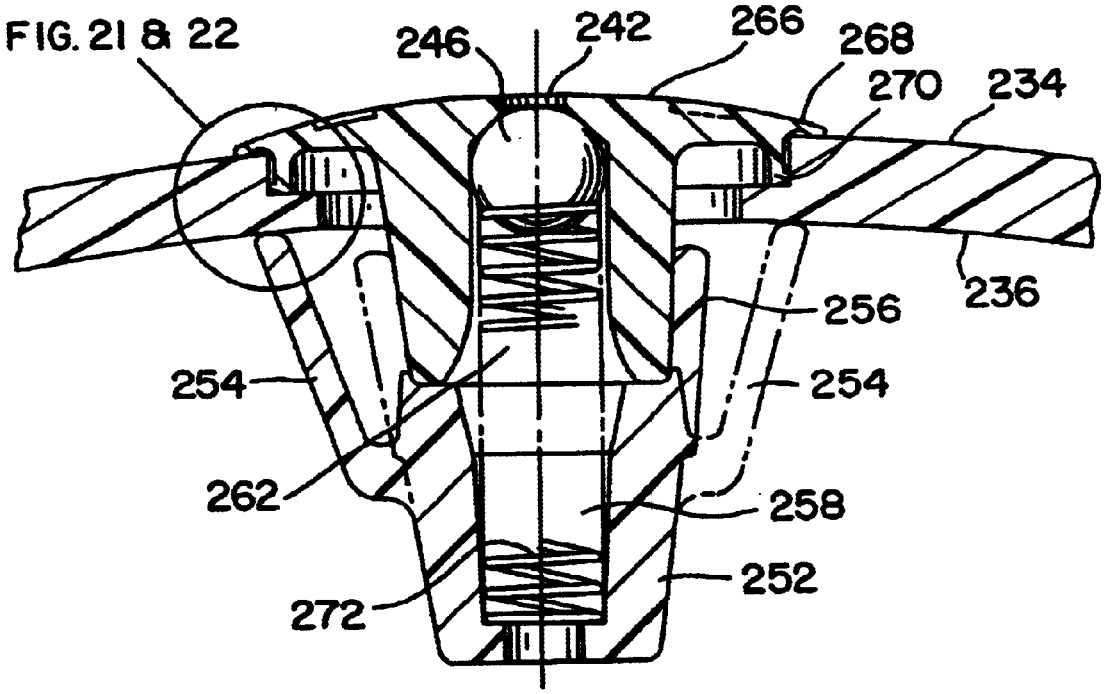
FIG. 20*b* is a cross-sectional view of the vent mechanism of FIG. 20*a* after insertion into the housing and particularly illustrates an embodiment of a resilient locking mechanism for locking the vent mechanism to the housing wall.
Figure 20A:
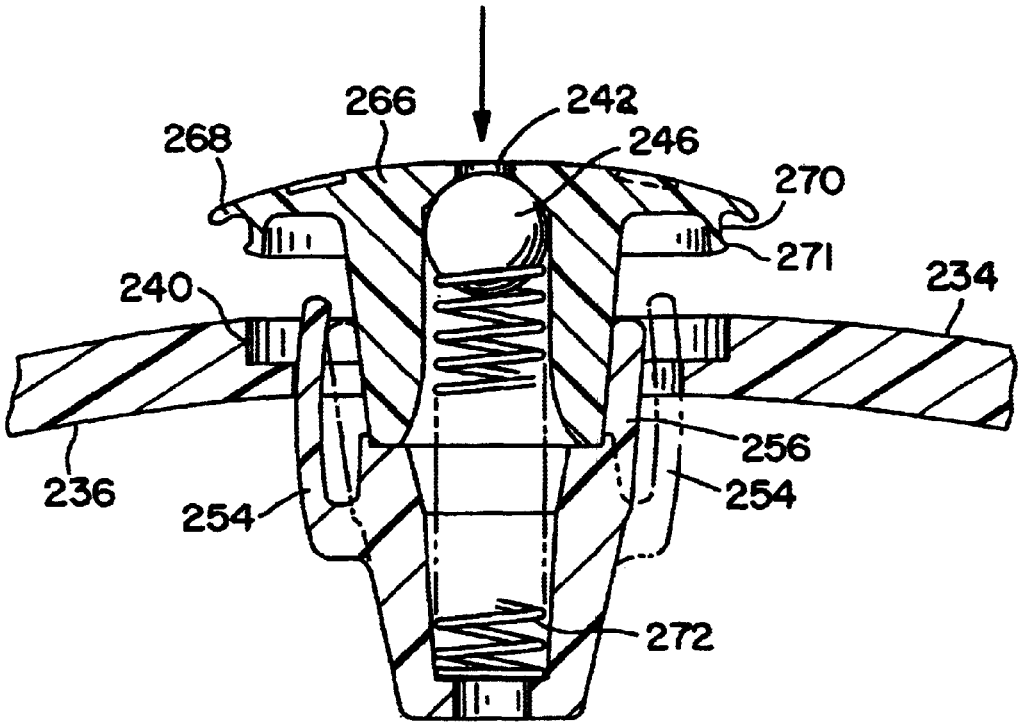
FIG. 20*a* is a cross-sectional view of the vent mechanism of FIG. 18 particularly showing insertion of the vent mechanism into an opening in the housing upper wall.

The lower body portion 252 is a generally cylindrical or truncated component defining a lower vent passage 258. At least one, and preferably a plurality, of resilient members, such as resilient tabs 254, are configured on the body to engage and secure the vent 230 to the housing wall 232. As particularly seen in FIGS. 20A and 20B, the resilient tabs 254 are angled away from a vertical axis through the lower body portion 252 so that they are able to flex inward upon insertion of the body 252 through the opening 238. Once the tabs 254 have cleared the inside surface 236 of the wall, they flex radially outward as shown in FIG. 20B. The vent 230 thus cannot thereafter be pulled from the housing.

The lower body portion 252 includes substantially rigid tabs 256 interspaced between the resilient tabs 254 and oriented generally parallel to a vertical axis through the body portion. These tabs 256 define a cage-like structure for receipt of the upper body portion 260.

It should be appreciated that various structural configurations are possible to define the resilient member and lower body portion 252, and that the illustrated embodiment is not intended to limit the invention.

The upper body portion 260 is a generally cylindrical member defining an upper vent passage 262 terminating in a vent orifice 242. The upper vent passage 262 is aligned with the lower vent passage 258 upon assembly of the upper body portion 260 with the lower body portion 252.

A vent plug, generally 244, is movably disposed in the vent passage 262 to seal the vent orifice 242 in an at-rest or static condition of the vent mechanism. In the illustrated embodiment, the vent plug is a ball 246 biased against inclined surface 264 by a spring 272. Thus, as can be readily seen in the figures, in its static position, the ball 246 is pressed against the inclined surface 264 and the vent orifice 242 is blocked. The reservoir 68 is thus essentially sealed to the external environment.

The upper body portion 260 further includes a cap, generally 266. The vent orifice 242 is defined through the center of the cap 266. In the illustrated embodiment, the cap 266 is a plate-like member and includes a resilient circumferential lip 268. This lip 268 defines a first seal between the vent mechanism and the dispenser housing. In its unstressed or relaxed state shown in dashed lines in FIGS. 21 and 22, the resilient lip has a radius of curvature greater than that of the remaining portion of the cap 266. Upon insertion of the vent through the housing opening 238, the lip 268 is pressed against a surface of the housing upper wall 232 and is caused to flatten out and seal against the housing surface. To ensure that a constant compressive force is applied to the cap 266, the vertical distance "d" (FIG. 23) between the edge of the lip 268 and the top of the resilient tabs 254 is greater than the thickness of the housing wall 232. In this way, once the vent has been inserted through the housing wall, the resilient tabs 254 also exert a constant downward pulling force on the cap 266 causing the resilient lip 268 to compress and seal against the housing surface.

Figure 21:
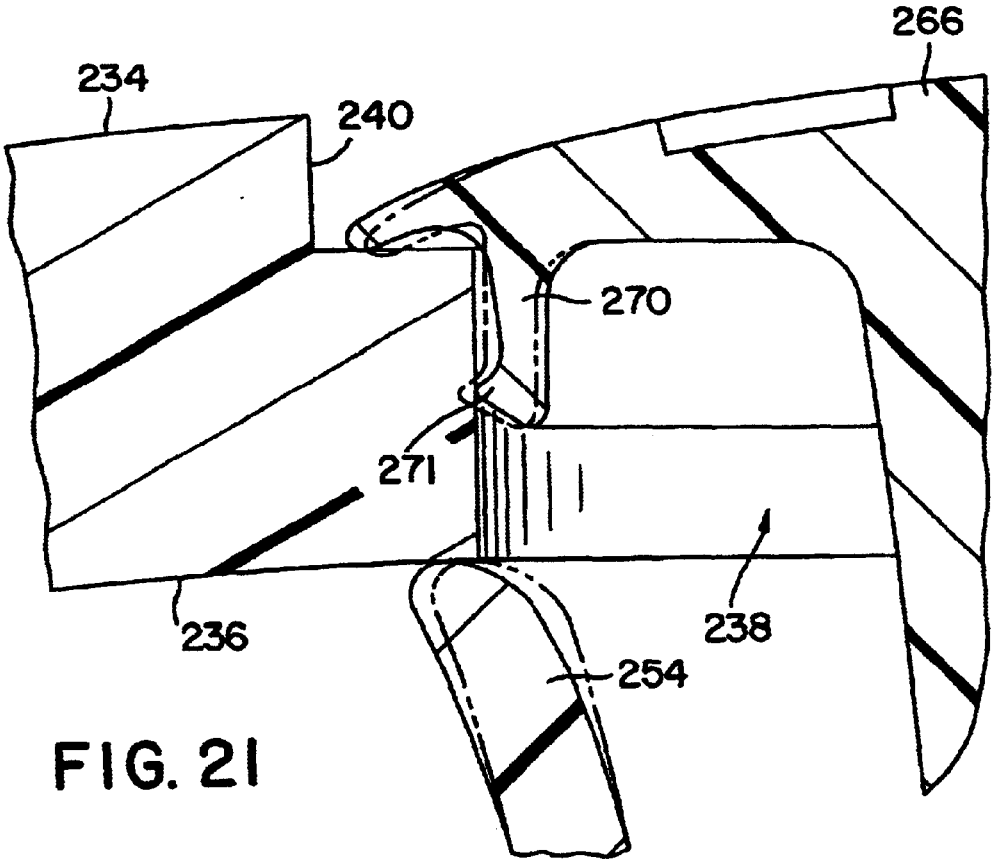
FIG. 21 is an enlarged cross-sectional view of the designated portion of FIG. 20*b* for a countersunk bore in the housing wall.
Figure 22:
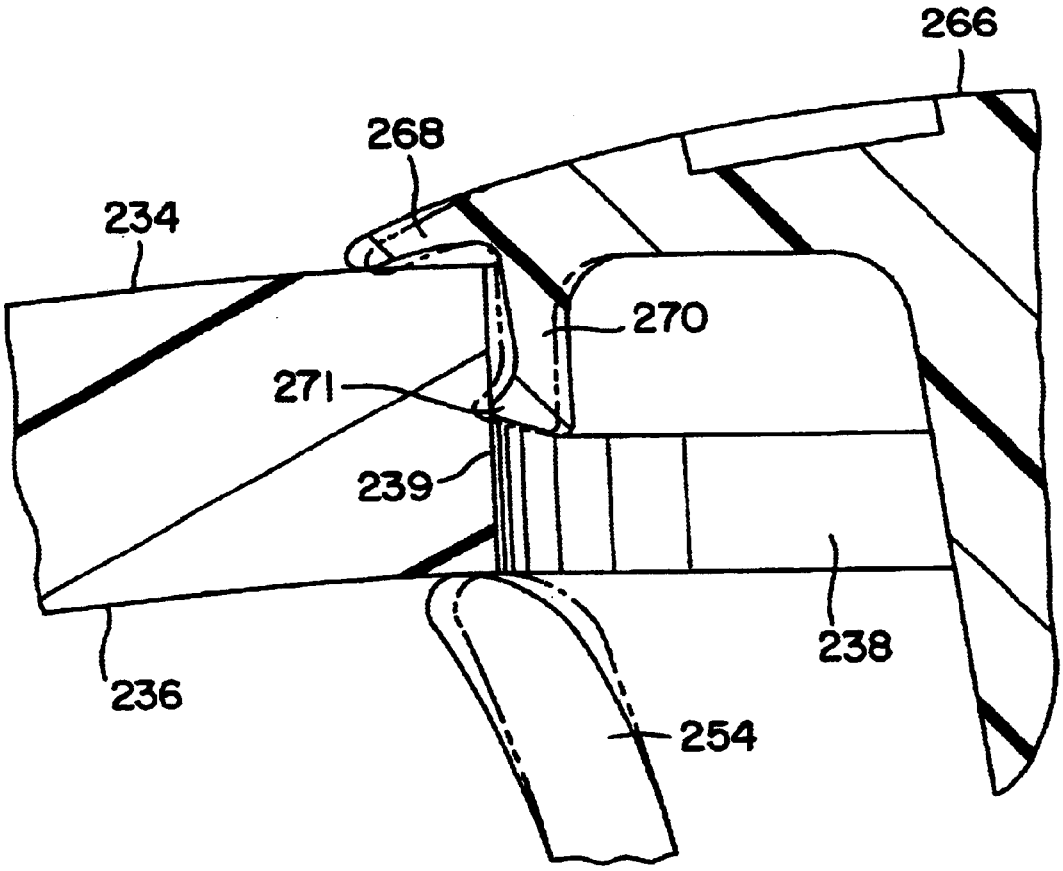
FIG. 22 is an enlarged cross-sectional view of the designated portion of FIG. 20*b* for a straight bore in the housing wall.

The upper body portion 260 also includes a resilient skirt member 270 extending downwardly from an underside of the cap 266. A foot 271 is defined at the end of the skirt 270. The skirt and foot configuration define an independent second seal between the vent mechanism and the dispenser housing. Referring to FIGS. 21 and 22, the skirt foot 271 has a relaxed or unstressed diameter greater than that of the opening 238 through the housing wall 232, as indicated by the dashed lines in the figures. Upon insertion of the vent mechanism through the opening 238, the skirt is compressed radially inward and the foot 271 sealingly engages against the wall 239 of the opening.

In the embodiment illustrated in FIG. 22, the opening 238 in the housing wall 232 is defined by a straight vertical wall 239. The foot 271 of the resilient skirt 270 seals against this wall 239 and the resilient lip 268 seals against the upper surface 234 of the housing wall. In this configuration, it is necessary that the skirt does not have a vertical length greater than the thickness of the housing wall 232.

In the embodiment of FIG. 21, the opening 238 is defined as a counterbore hole having a second wall 240 radially offset from the wall 239. In this configuration, the resilient lip seals against the counterbore circumferential wall or ledge 241 and the cap 266 is more or less flush with the upper surface 234 of the housing wall depending on the depth of the wall 240. In this configuration, the lip 268 should not extend to the second wall 240 and the skirt 270 should not extend below the wall 239.

Figure 18:
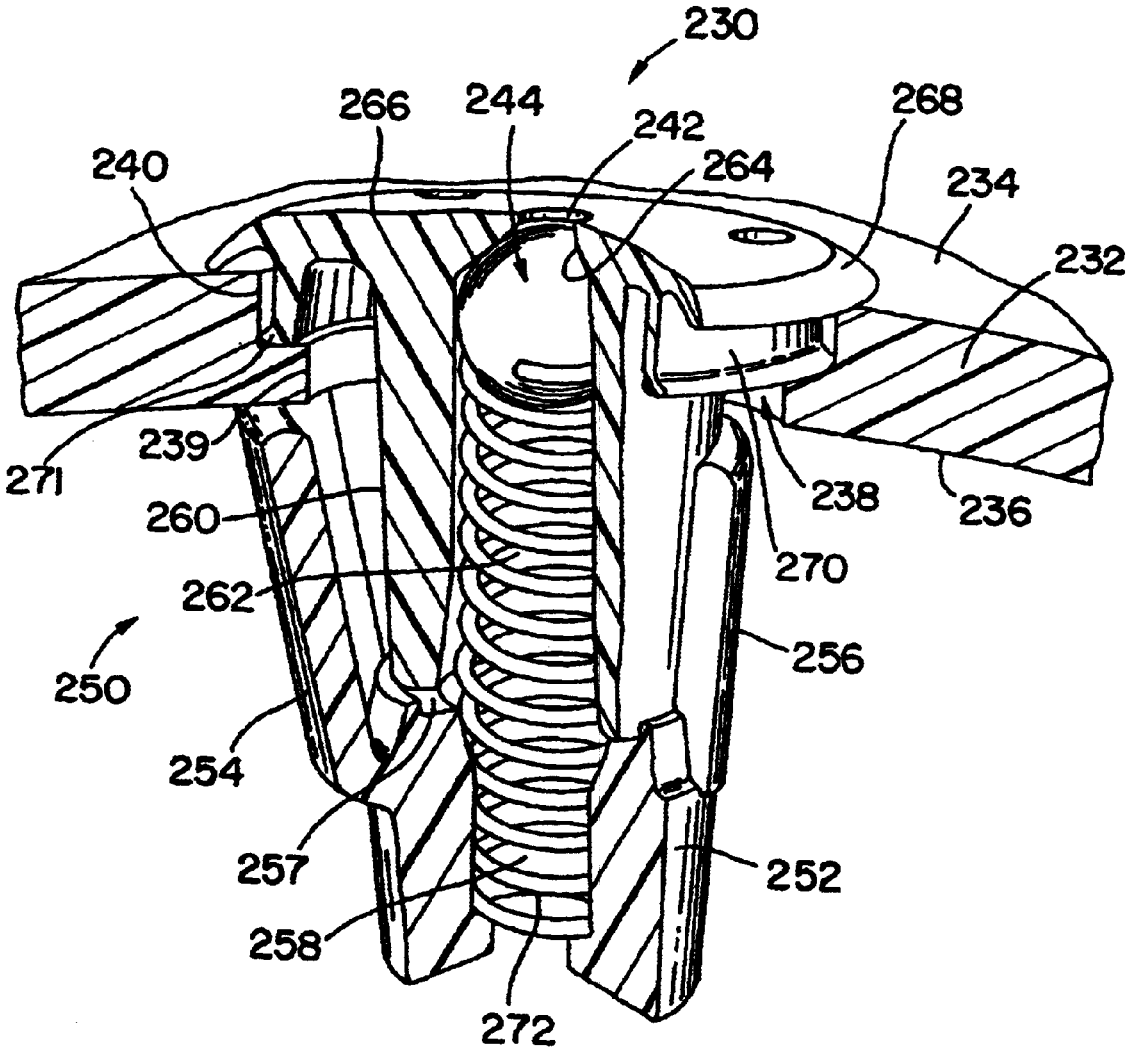
FIG. 18 is a perspective and partial cross-sectional view of an alternative embodiment of a vent mechanism is accordance with the invention.

In the embodiment of FIGS. 18 and 20B, the opening 238 is also a counterbore hole. However, in this configuration, the skirt foot 271 engages against the second wall 240 and the resilient lip 268 engages against the top surface 234 of the housing wall. The vertical length of the skirt 270 should not be greater than the depth of the second wall 240.

In a static or at-rest mode of the vent mechanism 230, the vent plug 244 (i.e., ball 246) is resiliently pressed into engagement against angled surface 264 defining the vent orifice 242. This engagement may be an essentially airtight seal. Upon a user actuating the pump mechanism to dispense a dose of viscous liquid from the reservoir 68, a partial vacuum is drawn in the reservoir and a pressure differential is established across the vent. This causes the vent plug to be pulled down or away from the vent orifice 242 against the force of the resilient member (i.e., spring 272). Once the vent plug unseats, pressure between the reservoir and the outside environment equalizes and the vent plug will subsequently reseat against the angled surface 264 until the next actuation of the pump mechanism. In this regard, it should be noted that the resilient member should be "sized" so that the vent plug can unseat from the vent orifice at the degree of vacuum generated inside the reservoir upon actuation of the pump mechanism. For example, if a spring 272 is utilized, such spring should not have a spring constant so great that the vent plug is prevented from unseating and equalizing pressure upon a user actuating the pump dispenser.

Figure 23:
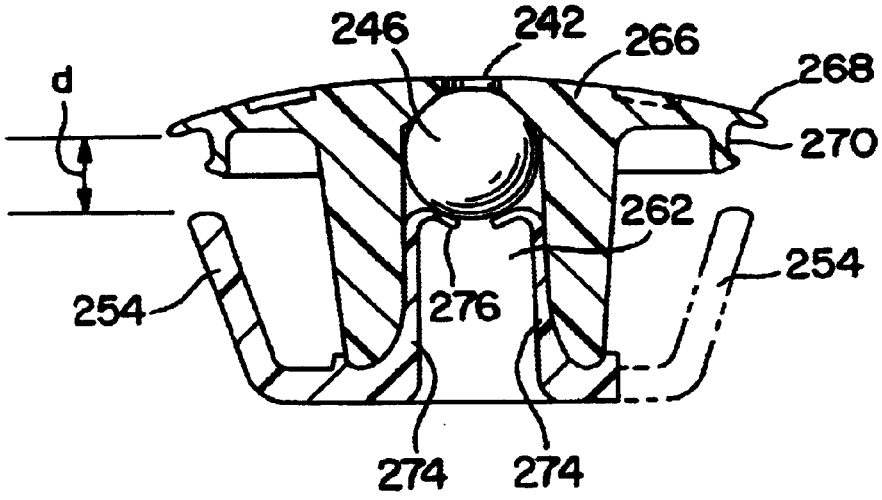
FIG. 23 is a cross-sectional view of an alternative embodiment of a vent mechanism according to the invention.

FIG. 23 illustrates an alternate embodiment of the vent mechanism wherein the body member includes a skirt portion 274 extending upwardly into the upper vent passage 262. The skirt portion need not be continuous and may constitute circumferentially spaced fingers or tabs This skirt portion 274 includes a resilient rim member 276 upon which the vent plug (ball 246) rests. This embodiment operates essentially the same as described above except that the vent plug is biased by the skirt 274 and resilient rim member 276 instead of a spring.

Figure 24:
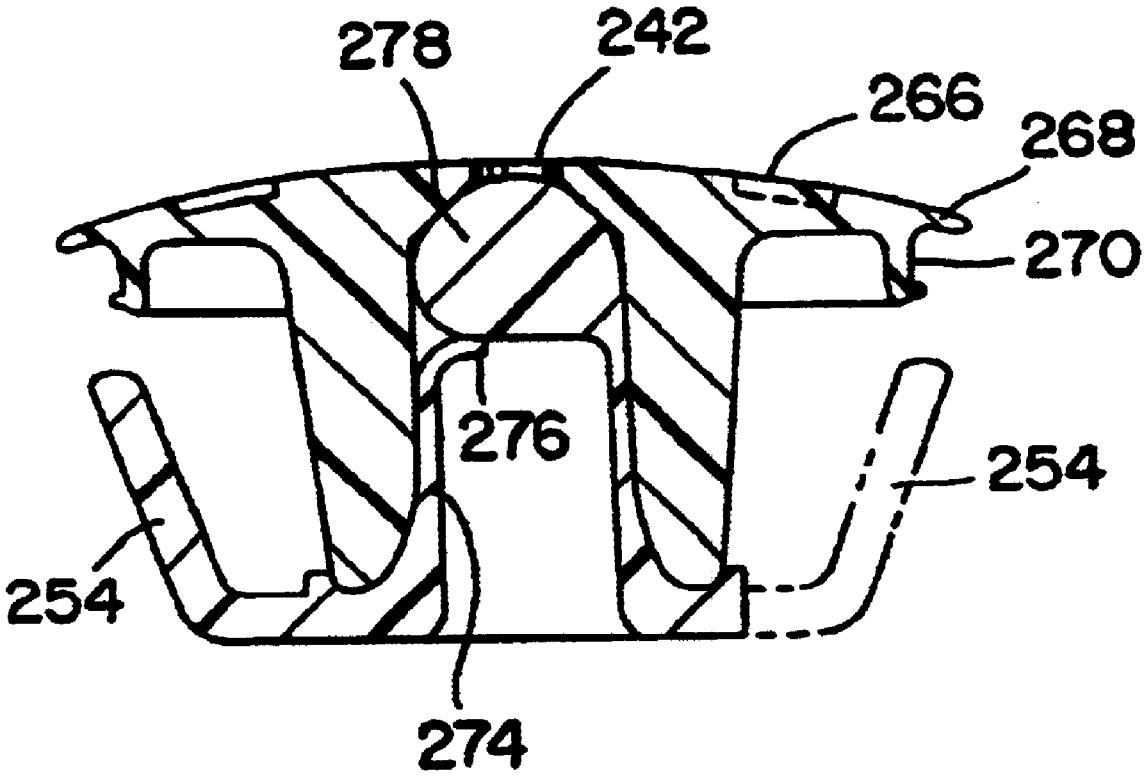
FIG. 24 is a cross-sectional view of an alternative embodiment of a vent mechanism according to the invention.

FIG. 24 illustrates an embodiment similar to that of FIG. 23. However, in this embodiment, the vent plug is a resiliently disposed bulbous member 278 formed integral to at least a portion of the skirt 274. The bulbous member 278 is supported by the resilient rim member 276. Operation of this embodiment is similar to that described above.

It should be appreciated that the invention includes modifications and variations to the embodiments of the invention described herein.

What is claimed is:

1. A self contained viscous liquid dispenser, comprising:

a housing;

an internal liquid reservoir defined by said housing, said reservoir defining a volume capacity for said dispenser;

a manually operated dispensing pump mechanism disposed in liquid communication with said reservoir and having a delivery end disposed for delivering metered doses of viscous liquid from said reservoir upon actuation thereof by a user;

a mounting mechanism formed integrally in said housing, said mounting mechanism detachably connectable with complimentary mounting structure on a wall surface such that upon mounting said housing, a substantial portion of the surface area of a back side of said housing surrounding said mounting mechanism is generally flush with the wall surface;

said housing and associated pump mechanism having a combined packaging weight in grams; and wherein a ratio of said packaging weight in grams to said volume capacity in liters does not exceed about 120:1.

2. The dispenser as in claim 1, wherein said ratio does not exceed about 100:1.

3. The dispenser as in claim 2, wherein said volume capacity is about 2.5 liters.

4. The dispenser as in claim 1, wherein at a first volume capacity said ratio is greater than at a second volume capacity that is greater than said first volume capacity.

5. The dispenser as in claim 1, wherein said mounting mechanism comprises a recess formed integrally in a back side of said housing, said recess further comprising side walls having engaging structures defined thereon for engagement with complimentary structure provided on the wall mounting structure.

6. The dispenser as in claim 5, wherein said recess has dimensions so that the complimentary wall mounting structure fits entirely within said recess such that upon mounting said dispenser on the wall surface, said back side of said dispenser is flush against the wall surface.

7. The dispenser as in claim 1, wherein said housing comprises a front component formed separately from and subsequently attached to a back component.

8. The dispenser as in claim 7, wherein said back component is more rigid than said front component.

9. The dispenser as in claim 7, wherein said back component is substantially translucent so that an operator can view the amount of liquid within said reservoir.

10. The dispenser as in claim 1, wherein said pump mechanism comprises a cylinder having a delivery channel defined therethrough, said cylinder being slidable within a substantially horizontally disposed chamber defined within said reservoir on a bottom surface of said housing.

11. The dispenser as in claim 10, wherein said chamber is formed integral with said housing.

12. A self contained viscous liquid dispenser, comprising:

a housing;

an internal liquid reservoir defined by said housing, said reservoir defining a volume capacity for said dispenser;

a manually operated dispensing pump mechanism disposed in liquid communication with said reservoir and having a delivery end disposed for delivering metered doses of viscous liquid from said reservoir upon actuation thereof by a user;

a mounting mechanism formed integrally in said housing, said mounting mechanism detachably connectable with complimentary mounting structure on a wall surface such that upon mounting said housing, a back side of said housing is generally flush with the wall surface;

said housing and associated pump mechanism having a combined packaging weight in grams;

wherein a ratio of said packaging weight in grams to said volume capacity in liters does not exceed about 120:1;

wherein said recess has dimensions so that the complimentary wall mounting structure fits entirely within said recess such that upon mounting said dispenser on the wall surface, said back side of said dispenser is flush against the wall surface;

wherein said mounting mechanism comprises a recess formed integrally in a back side of said housing, said recess further comprising side walls having engaging structures defined thereon for engagement with complimentary structure provided on the wall mounting structure; and wherein at least one dimension of said recess is less than the complimentary dimension for the corresponding mating component of the wall mounting structure such that upon mounting said housing onto the wall mounting structure, said recess is caused to flex to accommodate the oversized component of the wall mounting structure.

13. A self contained viscous liquid dispenser, comprising:

a housing;

an internal liquid reservoir defined by said housing, said reservoir defining a volume capacity for said dispenser;

a manually operated dispensing pump mechanism disposed in liquid communication with said reservoir and having a delivery end disposed for delivering metered doses of viscous liquid from said reservoir upon actuation thereof by a user;

a mounting mechanism formed integrally in said housing, said mounting mechanism detachably connectable with complimentary mounting structure on a wall surface such that upon mounting said housing, a back side of said housing is generally flush with the wall surface;

said housing and associated pump mechanism having a combined packaging weight in grams;

wherein a ratio of said packaging weight in grams to said volume capacity in liters does not exceed about 120:1;

wherein said recess has dimensions so that the complimentary wall mounting structure fits entirely within said recess such that upon mounting said dispenser on the wall surface, said back side of said dispenser is flush against the wall surface;

wherein said mounting mechanism comprises a recess formed integrally in a back side of said housing, said recess further comprising side walls having engaging structures defined thereon for engagement with complimentary structure provided on the wall mounting structure; and wherein said engaging structure comprises at least one angled surface disposed on at least one of said side walls that engages against a complimentary angled surface of the wall mounting structure.

14. A self contained viscous liquid dispenser, comprising:

a housing;

an internal liquid reservoir defined by said housing, said reservoir defining a volume capacity for said dispenser;

a manually operated dispensing pump mechanism disposed in liquid communication with said reservoir and having a delivery end disposed for delivering metered doses of viscous liquid from said reservoir upon actuation thereof by a user;

a mounting mechanism formed integrally in said housing, said mounting mechanism detachably connectable with complimentary mounting structure on a wall surface such that upon mounting said housing, a back side of said housing is generally flush with the wall surface;

said housing and associated pump mechanism having a combined packaging weight in grams;

wherein a ratio of said packaging weight in grams to said volume capacity in liters does not exceed about 120:1;

wherein said recess has dimensions so that the complimentary wall mounting structure fits entirely within said recess such that upon mounting said dispenser on the wall surface, said back side of said dispenser is flush against the wall surface; wherein said mounting mechanism comprises a recess formed integrally in a back side of said housing, said recess further comprising side walls having engaging structures defined thereon for engagement with complimentary structure provided on the wall mounting structure; and wherein said engaging structure comprises at least one angled surface disposed on each of opposite vertical side walls of said recess that engage against complimentary angled surfaces of the wall mounting structure.

15. The dispenser as in claim 14, wherein said engaging structure comprises at least two spaced apart angled surfaces on each of said opposite vertical side walls of said recess.

16. The dispenser as in claim 14, further comprising a securing device configured between said back side of said housing and the wall mounting structure to prevent sliding movement of said housing relative to the wall mounting structure upon engagement of said angled surfaces with the wall mounting structure.

17. The dispenser as in claim 16, wherein said securing device comprises a protrusion engageable in a complimentary divot.

18. The dispenser as in claim 17, wherein said protrusion is provided in said housing recess, and said divot is defined in the wall mounting structure.

19. The dispenser as in claim 17, wherein said protrusion is provided on the wall mounting structure, and said divot is provided in said housing recess.

* * * * *